US006593070B2

(12) United States Patent
Suda et al.

(10) Patent No.: US 6,593,070 B2
(45) Date of Patent: Jul. 15, 2003

(54) IMAGE FORMING PROCESS

(75) Inventors: Yoshihiko Suda, Hino (JP); Hiroyuki Hoshino, Hino (JP); Hiromichi Mizukami, Hino (JP); Hiromoto Ii, Hino (JP); Noriyuki Kokeguchi, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/023,669

(22) Filed: Dec. 18, 2001

(65) Prior Publication Data

US 2002/0132195 A1 Sep. 19, 2002

(30) Foreign Application Priority Data

Dec. 22, 2000 (JP) ..... 2000-390651
Mar. 5, 2001 (JP) ..... 2001-059960

(51) Int. Cl.[7] ..... G03C 7/407
(52) U.S. Cl. ..... 430/404; 430/466

(58) Field of Search ..... 430/404, 466

(56) References Cited

U.S. PATENT DOCUMENTS 5,164,280 A * 11/1992 Texter et al. ..... 430/202
5,200,302 A * 4/1993 Iwano ..... 430/376
5,695,916 A * 12/1997 Fyson ..... 430/403

* cited by examiner

*Primary Examiner*—Hoa Van Le
(74) *Attorney, Agent, or Firm*—Muserlian, Lucas and Mercanti

(57) ABSTRACT

An image formation process is disclosed, comprising overlapping an imagewise exposed silver halide photographic material onto a processing element with an aqueous medium being present between the photographic material and the processing element to perform development, thereby forming an image in the photographic material, wherein the aqueous medium contains at least a color developing agent or a precursor thereof, and the aqueous medium having a viscosity of 10.0 to 15000 cp at 25° C.

23 Claims, No Drawings

IMAGE FORMING PROCESS

FIELD OF THE INVENTION

The present invention relates to an image formation process and an image information preparation process of silver halide photographic light sensitive materials.

BACKGROUND OF THE INVENTION

Silver halide photographic light-sensitive materials (hereinafter, also denoted simply as photographic materials) are used as a recording material which is simple and low in cost but nonetheless capable of providing high quality images. These materials have greatly contributed to the advancement of industry and culture, and are indispensable material.

Silver halide color photographic material such as color negative film, after exposure, is subjected to color development to form yellow (Y), magenta (M) and cyan (C) dye images along with formation of silver images, which is subsequently subjected to bleaching to bleach the silver images to silver halide. The thus formed silver halide becomes a soluble silver complex and is removed from the photographic material. The photographic material is further subjected to a stabilization treatment to wash out any residual fixing agent and to cleanse the photographic material.

In the universally employed processing for color negative film (e.g., Process C-41 or CNK-4), as described above, the photographic material is subjected to many processing steps, often resulting in problems such that the processing time becomes relatively lengthy and the processing apparatus becomes larger. There also arise problems such that water is needed to make processing solutions and its dissolution work is hard, handling the relatively high pH solution is hazardous, it is troublesome to control exhausted processing solutions after processing, and disposal of processing effluents is not preferable for environment protection.

The foregoing problems have rarely arisen in large volume labs. Recently, on-site processing, so-called mini-lab has increased to enhance convenience of color film processing, for which a compact and rapid-accessible photographic processing system is desired, which can be handled even by a non-specialist or a part-time worker and is simple, safe and friendly to the environment. Further thereto, to achieve further enhancement of convenience of color films, it is also desired to introduce a photographic processing system into a place such as convenience stores, where a photographic processing apparatus has not been provided and therefore, development of a compact and rapid-accessible photographic processing system which functions in a simple and safe manner without discharging effluent and is friendly to the environment is desired to replace conventional processing systems.

Various attempts have been made in response to such a desire. For example, JP-A Nos. 9-325463 and 10-62938 (hereinafter, the term, JP-A refers to unexamined and published Japanese Patent Application) disclose a technique, in which a photographic material is superposed onto a processing element in the presence of water and the material is then heated to form images. Such a technique enables easy processing of a photographic material, but the photographic material used therein is a specific one which occludes a color developing agent and conventional color films are not applicable thereto.

JP-A Nos. 11-184055 and 11-65054 disclose a technique, in which a developer solution containing a color developing agent is coated or sprayed onto a photographic material to form dye images. Although this imaging process has the advantage that conventional color negative films are processable, handling the high pH solution containing the color developing agent in a relatively high concentration results in problems of safety and storage of the processing solution, so that the foregoing desire was not satisfied.

Nowadays, in the so-called digitization age, it is common that image information is optically read out from photographed and processed film to form images, using an image sensor such as film scanner, converted to electric signals and digitized, thereby, the image information can be stocked as signals and subjected to computer processing to obtain dye images using a photo-copy or a hard copy. In such an imaging process is generally performed an image input by using a digital camera provided with a solid-state image sensor as well as conventional silver salt photographic films (such as color negative film). However, high quality images cannot be obtained by low-priced digital cameras which are relatively low in pixel density and narrow in dynamic range and which is very much expensive relative to a conventional lens-fitted film. On the other hand, the process of reading image information after subjecting a photographic material to a simple processing inherently has the foregoing problems involved in photographic processing and is also not a satisfactory one.

SUMMARY OF THE INVENTION

In view of the foregoing, it is a first object of the present invention to provide an image forming process, which is high in safety and friendly to the environment.

It is a second object of the invention to provide an image forming process, which is easy in operation or control, rapid-accessible and superior in storage stability of an aqueous medium used in image formation.

It is a third object of the invention to provide an image forming process, which is easy to operate or control, rapid-accessible, thereby forming images at a high sensitivity and a low fogging level and with superior lasting quality.

It is a fourth object of the invention to provide an image forming process and image information preparing process, which are capable of taking dye image information as digital information at a low cost out of a universally employed color negative film.

The foregoing objects of the invention can be achieved by the following constitution:

1. An image formation process comprising:

(a) imagewise exposing a silver halide photographic material comprising on a support at least a silver halide emulsion layer to light, and (b) placing the exposed photographic material over a processing element, together with an aqueous medium being present between the photographic material and the processing element to perform development, thereby forming an image in the photographic material, wherein the aqueous medium contains at least a color developing agent or a precursor thereof, and the aqueous medium having a viscosity of 10.1 to 15000 cp at 25° C.

The present invention is further achieved by the following preferred embodiments:

2. The image formation process described in 1, wherein the aqueous medium has a pH of 4.0 to 11.0 at 25° C.;

3. The image formation process described in 2, wherein the aqueous medium has a pH of 4.0 to 9.0 at 25° C.;

4. The image formation process described in 1, wherein aqueous medium contains a base precursor;

5. The image formation process described in 1, wherein the color developing agent and the precursor thereof are respectively a compound represented by the following formula (1) and a compound capable of releasing or forming the compound represented by the formula (1) in the presence of alkali:

formula (1)

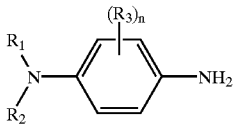

wherein $R_1$ and $R_2$ are each an alkyl group, an aryl group or a heterocyclic group, provided that $R_1$ and $R_2$ may combine with each other to form a ring; $R_3$ is an alkyl group, an aryl group or a heterocyclic group, provided that plural $R_3$s may combine with each other to form a ring; and n is an integer of 0 to 4;

6. The image formation process described in 1, wherein the aqueous medium contains at least one selected from the group consisting of compounds represented by the following formulas (2) through (7):

formula (2)

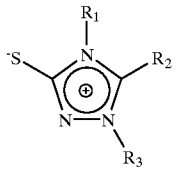

wherein $R_1$, $R_2$ and $R_3$ are each a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsufamoyl group, a sulfamoyl group, cyano group, an alkylsulfonyl group, an arylsulfonyl group, an alkoxycarbonyl group, an aryloxycarbonyl group, an alkylcarbonyl group, an arylcarbonyl group, an acyloxy group, a carboxyl group, a carbonyl group, a sulfonyl group, an amino group, a hydroxy group or a heterocyclic group;

formula (3)

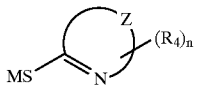

wherein M is a hydrogen atom, metal atom or quaternary ammonium; Z represents an atomic group necessary to form a N-containing heterocycric ring; n is an integer of 0 to 5; $R_4$ is a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsufamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, an acyloxy group, carboxyl group, a carbonyl group, a sulfonyl group, an amino group, a hydroxy group or a heterocyclic group, provided that when n is 2 or more, plural $R_4$s may be the same or different and may combine with each other to form a ring;

formula (4)

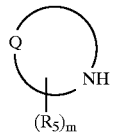

wherein Q represents an atomic group necessary to form a 5- or 6-membered N-containing heterocycric ring; m is an integer of 0 to 5; $R_5$ is a hydrogen atom, a halogen atom, an alkyl group, an aryl group, an alkylcarbonamido group, an arylcarbonamido group, an alkylsulfonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsufamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, an acyloxy group, a carboxyl group, a carbonyl group, a sulfonyl group, an amino group, a hydroxy group or a heterocyclic group, provided that when m is 2 or more, plural $R_5$s may be the same or different and may combine with each other to form a ring;

$H_2N—R_6$ formula (5)

wherein $R_6$ is an alkyl group, an aryl group or a heterocyclic group;

formula (6)

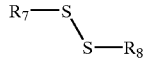

wherein $R_7$ and $R_8$ are each an alkyl group, aryl group or a heterocyclic group, provided that $R_7$ and $R_8$ may combine with each other to form a ring;

formula (7)

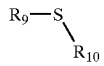

wherein $R_9$ and $R_{10}$ are each an alkyl group, aryl group or a heterocyclic group, provided that $R_9$ and $R_{10}$ may combine with each other to form a ring;

7. The image formation process described in 1, wherein the processing element contains at least one selected from the group consisting of compounds represented by formulas (2) through (7) as described in 6;

8. The image formation process described in 6, wherein the color developing agent and the precursor thereof are a compound represented by formula (1) as claimed in claim 5 and a compound capable of releasing or forming the compound represented by the formula (1) in the presence of alkali, respectively;

9. The image formation process described in 7, wherein the color developing agent and the precursor of the color developing agent are a compound represented by formula (1) as described in 5 and a compound capable of releasing or forming the compound represented by the formula (1) in the presence of alkali, respectively;

10. The image formation process described in 1, wherein the aqueous medium contains a compound represented by the following formula (A):

formula (A)

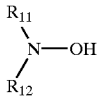

wherein $R_{11}$, and $R_{12}$ are each a hydrogen atom or an alkyl group, provided that $R_{11}$ and $R_{12}$ are not hydrogen atoms at the same time and $R_{11}$ and $R_{12}$ may combine with each other to form a ring;

11. The image formation process described in 1, wherein the photographic material is substantially free of a color developing agent and a precursor thereof;

12. The image formation process described in 1, wherein the processing element is substantially free of a color developing agent and a precursor thereof;

13. The image formation process described in 1, wherein the processing element contains a sparingly water-soluble basic metal compound, and the aqueous medium containing a complex forming compound;

14. The image formation process described in 1, where the processing element contains a complex forming compound, and the aqueous medium containing a sparingly water-soluble basic metal compound;

15. The image formation process described in 13, wherein the following requirement is met:

$$1 \leqq c/(a+b) \leqq 10$$

wherein "a" is an amount of gelatin contained in the photographic material (expressed in $g/m^2$), "b" is an amount of gelatin contained in the processing element (expressed in $g/m^2$) and "c" is an amount of the complex forming compound contained in the aqueous medium (expressed in $mmol/m^2$);

16. The image formation process described in 14, wherein the following requirement is met:

$$1 \leqq c/(a+b) \leqq 10$$

wherein "a" is an amount of gelatin contained in the photographic material (expressed in $g/m^2$), "b" is an amount of gelatin contained in the processing element (expressed in $g/m^2$) and "c" is an amount of the complex forming compound contained in the processing element (expressed in $mmol/m^2$);

17. The image formation process described in 13, wherein the following requirement is met:

$$0.2 \leqq d/c \leqq 6$$

wherein "c" is an amount of the complex forming compound contained in the aqueous medium (expressed in $mmol/m^2$ unit) and "d" is an amount of the sparingly water-soluble basic metal compound contained in the processing element (expressed in $mmol/m^2$ unit);

18. The image formation process described in 14, wherein the following requirement is met:

$$0.2 \leqq d/c \leqq 6$$

wherein "c" is an amount of the complex forming compound contained in the processing element (expressed in $mmol/m^2$ unit) and "d" is an amount of the sparingly water-soluble basic metal compound contained in the aqueous medium (expressed in $mmol/m^2$ unit);

19. The image formation process described in 1, wherein the following requirement is met:

$$1 \leqq e/(a+b) \leqq 6$$

wherein "a" is an amount of gelatin contained in the photographic material (expressed in $g/m^2$ unit), "b" is an amount of gelatin contained in the processing element (expressed in $g/m^2$ unit) and "e" is an amount of water contained in the aqueous medium (expressed in $g/m^2$ unit);

20. The image formation process described in 1, wherein the following requirement is met:

$$3 \leqq f \leqq 40$$

wherein "f" is an amount of the color developing agent or the precursor thereof contained in the aqueous medium (expressed in $mmol/m^2$ unit);

21. The image formation process described in 1, wherein in step (b), the aqueous medium is provided onto the processing element and further thereon, the photographic material is placed;

22. The image formation method described in 1, wherein in step (b), the development is performed at a temperature of 43° C. to 95° C.;

23. The image formation process described in 22, wherein in step (b), the development is performed at a temperature of 50° C. to 95° C.;

24. The image formation process described in 1, wherein the photographic material comprises on a support a blue-sensitive silver halide emulsion layer containing a yellow dye forming coupler, a green-sensitive silver halide emulsion layer containing a magenta dye forming coupler and a red-sensitive silver halide emulsion layer containing a cyan dye forming coupler;

25. A process of preparing image information, wherein an image formed in the photographic material according to the image formation process described in any of 1 through 24 is read by an image sensor to convert it to electric signals;

26. The process of preparing image information described in 25, wherein the formed image information is read substantially without removing silver or a silver compound from the photographic material; and 27. The process of preparing image information described in 25 or 26, wherein the formed image information is read without peeling the processing element.

DETAILED DESCRIPTION OF THE INVENTION

The present invention concerns an image formation process comprising superposing the exposed photographic material onto a processing element, together with an aqueous medium interposed between the photographic material and the processing element to perform development, thereby forming an image in the photographic material, wherein the aqueous medium contains at least a color developing agent or a precursor thereof, and the aqueous medium having a viscosity of 10.1 to 15000 cp at 25° C.

The aqueous medium for use in image formation in the invention will be described. The aqueous medium used in the invention contains at least one color developing agent and/or a precursor of the color developing agent.

The color developing agent refers to a compound capable of oxidizing silver halide having a latent image and becoming an oxidized product, which reacts with a coupler to form a dye. Examples of the color developing agent include compounds (C-1) through (C-16) described in JP-A No.

4-86741 at page 7 to 9; compounds (1) through (8) described in JP-A No. 61-289350 at page 29 to 31; compounds (1) through (62) described in JP-A No. 3-246543 at page 5 to 9; exemplified compounds (C-1) and (C-3) described in JP-A No. 4-86741; exemplified compound (2) described in JP-A No. 61-289350; exemplified compound (1) described in JP-A No. 3-246543; sulfonamidophenol type color developing agents represented by formula (8) through (12) described in JP-A No. 2001-154325; sulfonamidoaniline type color developing agents and hydrazine type color developing agents. In addition thereto are also usable precursors of a p-phenylenediamine type color developing agent represented by formulas (1) through (6) described in JP-A Nos. 5-241305 and 11-167185 and Japanese Patent Application No. 11-358973. Of these, p-phenylenediamine type color developing agents are preferably used to efficiently achieve the objects of the invention and compounds having water-solubilizing group (i.e., a group promoting solubility in water) such as a hydroxy group or sulfonyl group are preferably used.

In the invention, preferred p-phenylenediamine type color developing agent is represented by the following formula (1):

formula (1)

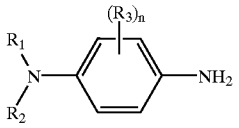

wherein $R_1$ and $R_2$ are each an alkyl group, an aryl group or a heterocyclic group, provided that $R_1$ and $R_2$ may combine with each other to form a ring; $R_3$ is an alkyl group, an aryl group or a heterocyclic group, provided that plural $R_3$s may combine with each other to form a ring; and n is an integer of 0 to 4.

A precursor of a color developing agent (hereinafter, also denoted as a color developing agent precursor) usable in the invention is preferably a compound capable of releasing or forming the compound represented by the foregoing formula (1) in the presence of alkali.

The compound capable of releasing or forming the compound represented by formula (1) in the presence of alkali is preferably a compound represented by the following formula (1B):

formula (1B)

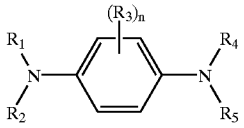

wherein $R_1$ and $R_2$ are each an alkyl group, an aromatic group or a heterocyclic group, provided that $R_1$ and $R_2$ may combine with each other to form a ring; $R_3$ is an alkyl group, an aromatic group or a heterocyclic group, provided that plural $R_3$s may combine with each other to form a ring; $R_4$ and $R_5$ are hydrogen atom or a group capable of becoming a hydrogen on hydrolysis, provided that $R_4$ and $R_5$ are not hydrogen atoms at the same time and may combine with each other to form a ring; and n is an integer of 0 to 4.

Examples of the color developing agent precursor include compounds 1- through 1-18, 2-1 through 2-22, 3-1 through 3-13, 4-1 through 4-8 and 5-1 through 5-8, described in Japanese Patent Application No. 2000-312253.

The aqueous medium preferably exhibits a pH of 4.0 to 11.0 at 25° C. The pH at the time of color development needs to be relatively high to perform color development. In the invention, releasing alkali needed for development from a base precursor described later achieved lowering of the pH of the aqueous medium. Thereby, storage stability of a color developing agent or its precursor contained in the aqueous medium was enhanced and dissolution in the aqueous medium at a high concentration was also achieved, providing stable dye images having a high density.

The viscosity of the aqueous medium needs to be 10.1 to 15000 cp (centi-poise) at 25° C. to effectively accomplish the objects of the invention. In cases when the viscosity is lower than the foregoing range, unevenness in development easily occur, and the viscosity higher than the range causes disadvantages such as lowering in color density. The viscosity is preferably 15 to 3000 cp, and more preferably 100 to 2500 cp. Techniques for controlling the viscosity include, for example, allowing a water-soluble polymer to be contained in a processing solution within the range having no effect on processing performance and allowing a hydrophilic solvent other than water to be contained in the processing solution to the extent having no effect on processing performance, but is not specifically limited to these examples. Examples of the water-soluble polymer include vinyl polymers and their derivatives such as polyvinyl alcohols, polyvinyl pyrrolidones, polyvinyl pyridinium halide and various modified polyvinyl alcohol; acryl group-containing polymers such as polyacrylamide, polydimethylacrylamide, polydimethylaminoacrylate, poly (sodium acrylate), a salt of copolymer of acrylic acid and methacrylic acid, poly(sodium methacrylate) and a salt of a copolymer of acrylic acid and vinyl alcohol; natural polymeric material and its derivative such as starch, oxidized starch carboxyl starch, dialdehyde starch, cationic starch, dextrin, sodium alginate, Arabic gum, casein, pullulan, dextran, methyl cellulose, ethyl cellulose, carboxymethyl cellulose, and hydroxypropyl cellulose; synthetic polymers such as polyethylene glycol, polypropylene glycol, polyvinyl ether, polyglycerin, copolymer of alky maleate and vinyl ether, copolymer of maleic acid and N-vinylpyrrole, copolymer of styrene and anhydrous maleic acid and polyethyleneimine.

To effectively accomplish the objects of the invention, it is preferred to control the amount of a color developing agent or its precursor supplied from the aqueous medium. Thus, the total amount (represented by "f" mmol/l) of a color developing agent or its precursor supplied from or contained in the aqueous medium preferably be within the following range:

$$3 \leqq f \leqq 40 \ (mmol/m^2).$$

When the amount (f) is adjusted to fall within this range, sufficiently high color density is obtained and fogging is minimized and since the color developing agent or its precursor is not needed to be dissolved in the aqueous medium at a relatively high concentration, deterioration in storage stability of the aqueous medium can be minimized.

The aqueous medium used in the invention may be comprised of a single solution or a mixture of plural sub-solutions (or partial solutions). When mixing plural sub-solutions, the sub-solutions may be mixed on the surface of a photographic material or processing element. Alternatively, immediately after the sub-solutions are mixed, the mixture is placed onto the photographic material or processing element. The aqueous medium is preferably comprised of a single solution in terms of simplification of the processing apparatus structure and uniformity of processing.

Next, the processing element used in the invention will be described. The processing element refers to a sheet-form element, onto which the photographic material is placed in the presence of an aqueous medium between the photographic material and the element to perform color development, thereby images on the photographic material. The processing element is a sheet-form element comprising a support, such as employed in conventional photographic materials, having thereon a binder layer, which optionally contains a specified compound. As a support of the processing element is usable one which is used as a support of conventional photographic materials. Examples thereof include polyolefin film such as polyethylene, polystyrene film, polycarbonate film, cellulose derivative film such as cellulose triacetate, polyester film such as polyethylene terephthalate or polyethylene naphthalate, polyester film having introduced a substituent such as a polar group, and polyimide film obtained from reaction of pyromellitic acid or its anhydride and diamine. In cases when reading images without removing silver or a silver compound from a photographic material or without peeling the processing element after being processed, it is desirable that the optical density of the support used in a processing element preferably is as low as possible.

As binders coated on the processing element are usable those which are the same as used in conventional photographic materials, and hydrophilic binders are preferred. Examples thereof include compounds described in Research Disclosure and JP-A 64-13546 at page (71) to (75). Transparent or translucent, hydrophilic binders are preferable and transparent binders are more preferable. Examples of a preferred binder include natural products, e.g., protein or cellulose derivatives such as gelatin or gelatin derivatives, polysaccharides such as starch, Arabic gum, dextrin, pulullan and colorgienan; and synthetic polymeric compounds such as polyvinyl alcohol, polyvinyl pyrrolidine, polyacrylamide. High water-absorbing polymers described in U.S. Pat. No. 4,960,681 and JP-A 62-245260, i.e., a homopolymer of a vinyl monomer and a copolymer of different vinyl monomers or a copolymer of a vinyl monomer and other vinyl monomer (e.g., sodium methacrylate, ammonium methacrylate, potassium acrylate) are also usable. These binders may be used alone or in combination thereof. In the case of being used in combination, a combination of gelatin and other binder is preferred. Gelatin may be selected from lime-processed gelatin, acid-processed gelatin and decalcified gelatin and their combined use is also preferred.

Next, a base precursor used in the invention will be described. To effectuate the objects of the invention, the base precursor is used as an alkali-supplying source. The base precursor used in the invention refers to a compound capable of releasing alkali upon reaction. Examples thereof include a base-generating compound described in JP-A Nos. 56-13745 and 57-132332; compounds releasing or forming an base component upon heating, as described in British Patent No. 998,949, U.S. Pat. Nos. 3,220,846 and 3,523,795, JP-A Nos. 50-22625, 59-168440, 59-168441, 59-180537, 60-237443, 61-32844, 61-36743, 61-52639, 61-51139, 61-51140, 61-52638, 61-53631, 61-53634, 61-53635, 61-53636, 61-53637, 51-53638, 61-53639, 6-53640, 61-55644, 61-55645, 55-646, 61-219950, and 61-251840; and a combination of a sparingly water-soluble basic metal compound and a compound capable of releasing alkali upon complex forming reaction, through water as medium, with a metal ion constituting the sparingly water-soluble basic metal compound, as described in European Patent No. 210,660 and U.S. Pat. No. 4,740,445. Preferred base precursors used in the invention include the combined use of a sparingly water-soluble basic metal compound and a compound capable of releasing alkali upon complex forming reaction with a metal ion constituting the sparingly water-soluble basic metal compound together with water as medium.

In the invention, the foregoing sparingly water-soluble basic metal compound (hereinafter, also called a sparingly soluble metal compound) and compound releasing alkali upon complex forming reaction with a metal ion constituting the basic metal compound, through water as medium (hereinafter, also called a complex forming compound or complexing agent) are each defined as a base precursor. Compounds forming a complex with a metal ion constituting the sparing soluble metal compound include, for example, aminoacrboxylic acid and its salt such as ethylenediaminetetraacetic acid, nitrilotriacetic acid, and diethylenetriaminepentaacetic acid; aminosulfonic acid and its salt; pyridylcarboxylic acid and its salt such as 2-picolinic acid, pyridine-2,6-dicarboxylic acid, and 5-ethyl-2-picolinic acid; and iminodiacetic acid and its salt such as benzylaminodicarboxylic acid and -picolyliminodiacetic acid. The complex forming compound (or complexing compound) is preferably used in the form of a salt formed by neutralization with an organic base such as guanidine or alkali metal such as sodium.

Examples of the sparingly water-soluble basic metal compound include a metal oxide, metal hydroxide, metal carbonate, metal phosphate, metal silicate, metal nitrate, and metal aluminate, each of which exhibits a solubility in water at 25° C. of 0.5 or less. Specifically, a metal compound represented by the following formula (M) is preferred:

$$Z_gX_h \qquad \text{formula (M)}$$

wherein Z represents a metal ion other than alkali metal ions; X represents an oxide ion, hydroxide ion, carbonate ion, phosphate ion, silicate ion, nitrate ion or aluminate ion; g and h each represent an integer necessary to allow the valence number of Z to counterbalance that of X.

The metal compound represented by formula (M) may be present in a hydrated form or may form a double salt. In formula (M), "Z" is preferably $Zn^{2+}$, $Co^{2+}$, $Ni^{2+}$, $Fe^{2+}$, $Mn^{2+}$, $Cu^{2+}$, $Hg^{2+}$, $Zr^{2+}$, $Ba^{2+}$, $Sr^{2+}$ or $Ca^{2+}$, and more preferably $Zn^{2+}$. "X" is preferably a oxide ion, hydroxide ion, phosphate ion or carbonate ion. Examples of the metal compound include $Zn(OH)_2$, ZnO, $Co(OH)_2$, CoO, $Ni(OH)_2$, $Cu(OH)^2$, $Fe(OH)_2$, $Mn(OH)_2$, $BaCO_3$, basic zinc carbonate, basic cobalt carbonate, basic nickel carbonate and basic bismuth carbonate. Specifically, when dispersed in water, a compound causing no coloring in the dispersion is preferred. The base precursor is introduced by allowing at least a base precursor to be contained in the foregoing aqueous medium. In cases when supplying the combination of the complexing compound and sparingly soluble metal compound from the aqueous medium, as described earlier, it is preferred that the aqueous medium be divided to two or more sub-solution, and the complexing compound and sparingly soluble metal compound are separately introduced into the sub-solutions.

In one preferred embodiment of the invention, the complexing compound is contained in the aqueous medium and the sparingly soluble metal compound is contained in the processing element. Alternatively, the sparingly soluble metal compound is contained in the aqueous medium and the complexing compound is contained in the processing element. In this case for example, when the processing element contains the sparingly soluble metal compound and the aqueous medium contains the complexing compound, it is desirable that any complexing compound be substantially not contained in the processing element and any sparingly soluble metal compound be substantially not contained in the aqueous medium.

To achieve effective accomplishment of the objects of the invention, it is preferred to adjust the relationship in amount between the total amount of gelatin contained in the silver halide photographic material and processing element and the ratio of a sparingly soluble metal compound to a complexing compound. Thus, in one preferred embodiment of the invention, the following requirement is met:

$$1 \leqq c/(a+b) \leqq 10$$

where "a" and "b" are amounts of gelatin contained in the photographic material and processing element, respectively (expressed in $g/m^2$); and "c" is the amount of a complexing compound contained in the processing element or provided by the aqueous medium (expressed in $g/m^2$). Further, in one preferred embodiment of the invention, the following requirement is met:

$$0.2 \leqq d/c \leqq 6$$

where "d" is the amount of a sparingly soluble metal compound contained in the processing element or provided by the aqueous medium (expressed in $g/m^2$)

Gelatin has a buffer capacity in pH and to maintain a sufficient amount of alkali, it is of importance to adjust amounts of gelatin and a complexing compound and amounts of the complexing compound and a sparingly soluble metal compound. The complexing compound, depending on the kind, has more or less restraining effect on development of silver halide. Such a restraining effect produces no serious problem in silver halide emulsions exhibiting high developability used in photographic materials for appreciation. However, there is not a little influence on silver halide emulsions containing a relatively high iodide and exhibiting low developability, used in photographic materials for camera use, such as color negative film used in the invention. From this point of view, the foregoing requirement regarding the amount is of importance.

Supplying the color developing agent and/or its precursor from an aqueous medium of a given pH enables to obtain a color image stably having a high density and also to process conventional photographic material such as color negative film. To achieve the objects of the invention, accordingly, it is preferred that the foregoing photographic material is substantially free of the color developing agent and/or its precursor and the processing element described earlier also is substantially free of the color developing agent and/or its precursor. The photographic material or processing element being substantially free of a color developing agent and/or its precursor enhances aging stability of the photographic material or processing element and enables to obtain invariably stable color images. Herein, the photographic material or processing element being substantially free of a color developing agent and/or its precursor means that the photographic material or processing element contains a color developing agent and/or its precursor in an amount of not more than 0.01 $mmol/m^2$.

In one preferred embodiment of the invention, the amount of water supplied by the aqueous medium is specifically limited. Thus, the following requirement is preferably met:

$$1 \leqq e/(a+b) \leqq 6$$

where "a" and "b" are amounts of gelatin contained in the photographic material and the processing element, respectively (expressed in $g/m^2$); and "e" is the amount of water provided by the aqueous medium (expressed in $g/m^2$). In cases when the amount of water is less than that represented by the foregoing range, color development reaction is not sufficiently caused up to the lowest layer, and when the amount of water exceeds that represented by the foregoing range, the aqueous medium is squeezed out of the spacing between the photographic material and processing element, staining the interior of a processor and causing troubles such as unevenness in development.

After the aqueous medium according to the invention is provided to a processing element, the processing element may be superposed onto a photographic material. Alternatively, after the aqueous medium is provided to a photographic material, the photographic material may be superposed onto a processing element. To efficiently achieve the objects of the invention, it is effective that after the aqueous medium is provided to a processing element, the processing element be superposed onto a photographic material.

Next, there will be described additives that are introduced into the aqueous medium and/or processing element.

In one preferred embodiment of the invention, the aqueous medium contains at least one selected from compounds represented by formulas (2) through (7). Formula (2) will be explained:

Formula (2)

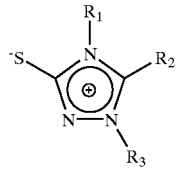

wherein $R_1$, $R_2$ and $R_3$ are each a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsufamoyl group, a sulfamoyl group, cyano group, an alkylsulfonyl group, an arylsulfonyl group, an alkoxycarbonyl group, an aryloxycarbonyl group, an alkylcarbonyl group, an arylcarbonyl group, an acyloxy group, carboxyl group, carbonyl group, sulfonyl group, an amino group, hydroxy group or a heterocyclic group.

Examples of a halogen atom represented by $R_1$ through $R_3$ of formula (2) include fluorine atom, chlorine atom, bromine atom, iodine atom; examples of an alkyl group include methyl, ethyl, propyl, i-propyl, butyl, t-butyl, pentyl, cyclopentyl, hexyl, cyclohexyl, octyl, dodecyl, hydroxyethyl, methoxyethyl, trifluoromethyl, and benzyl; examples of an aryl group include phenyl and naphthyl; examples of an alkylcarbonamido group include acetylamino, propionylamino and butyloylamino; examples of an arylcarbonamido group include benzoylamino; examples of an alkylsulfonamido group include methanesulfonylamino and ethanesulfonylamino; examples of an arylsulfonamido group include benzenesulfonylamino and toluenesulfonylamino; examples of an aryloxy group include phenoxy; examples of an alkylthio group include methylthio, ethylthio and butylthio; examples of an arylthio group include phenylthio and tolylthio; examples of an alkylcarbamoyl group include methylcarbamoyl, dimethylcarbamoyl, ethylcarbamoyl, dimethylcarbamoyl, dibutylcarbamoyl, piperidylcarbamoyl, and morpholylcarbamoyl; examples of an arylcarbamoyl group include phenylcarbamoyl, methylphenylcarbamoyl, ethylphenylcarbamoyl and benzylphenylcarbamoyl; examples of an alkylsulfamoyl group include methylsulfamoyl, dimethylsulfamoyl, ethylsulfamoyl, diethylsulfamoyl, dibutylsufamoyl, piperidylsulfamoyl, and morpholylsulfamoyl; examples of an arylsulfamoyl group include phenylsulfamoyl, methylphenylsulfamoyl, ethylphenylsulfamoyl, and benzylphenylsulfamoyl; examples of an alkylsulfonyl group include methanesulfonyl, and ethanesulfonyl; examples of an arylsulfonyl group include phenylsufonyl, 4-chlorophenylsulfonyl and p-toluenesulfonyl; examples of an alkoxycarbonyl group include methoxycarbonyl, ethoxycarbonyl and butoxycarbonyl; examples of an aryloxycarbonyl group include phenoxycarbonyl; examples of an alkylcarbonyl group include acetyl, propionyl and butyloyl; examples of an arylcarbonyl group include benzoyl, and alkylbenzoyl; examples of an acyloxy group include acetyloxy, propionyloxy and butyloyloxy; examples of heterocyclic group include a oxazole ring, imidazole ring, thiazole ring, triazole ring, selenazole ring, tetrazole ring, oxadiazole ring, thiadiazole ring, thiazine ring, triazine ring, benzoxazole ring, benzthiazole ring, benzimidazole ring, indolenine ring, benzoselenazole ring, naphthothiazole ring, triazaindolizine ring, diazaindolizine ring, and tetrazaindoline ring. These substituent groups may be substituted by substituent (s).

Preferred examples of the compound represented by formula (2) are by no means limited to these examples.

2-1

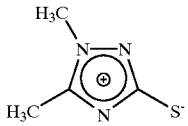

2-2

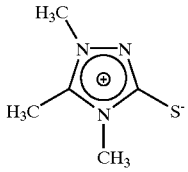

2-3

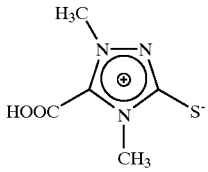

2-4

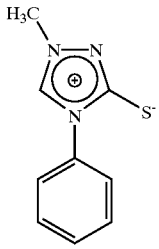

-continued 2-5

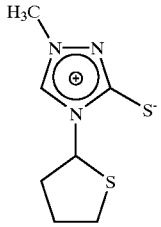

2-6

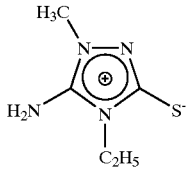

2-7

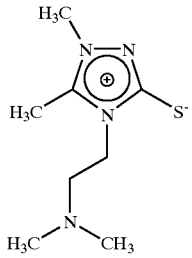

2-8

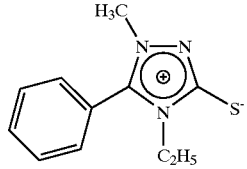

2-9

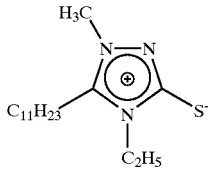

2-10

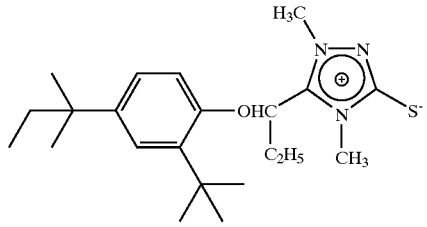

2-11

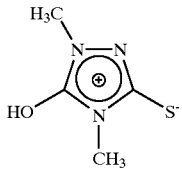

2-12

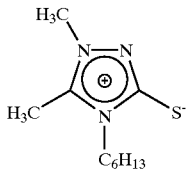

-continued 2-13

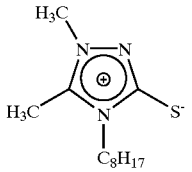

2-14

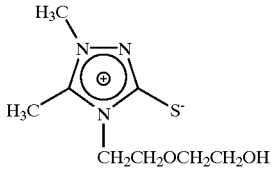

2-15

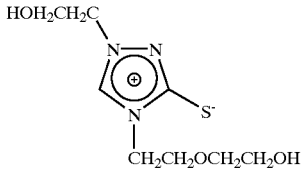

Next, formula (3) will be described:

Formula (3)

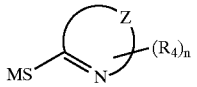

wherein M is a hydrogen atom, a metal atom or quaternary ammonium; Z represents an atomic group necessary to form a N-containing heterocycric ring; n is an integer of 0 to 5; $R_4$ is a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsufamoyl group, a sulfamoyl group, cyano group, an alkylsulfonyl group, an arylsulfonyl group, an alkoxycarbonyl group, an aryloxycarbonyl group, an alkylcarbonyl group, an arylcarbonyl group, an acyloxy group, carboxyl group, carbonyl group, sulfonyl group, an amino group, hydroxy group or a heterocyclic group, provided that when n is 2 or more, plural $R_4$s, which may be the same or different may combine with each other to form a ring.

Examples of the metal atom represented by M of formula (3) include Li, Na, K, Mg, Ca, Zn, Ag; and examples of the quaternary ammonium include $NH_4$, $N(CH_3)_4$, $N(C_4H_9)_4$, $N(CH_3)_3C_{12}H_{25}$, $N(CH_3)_3C_{16}H_{33}$, and $N(CH_3)_3CH_2C_6H_5$. Example of the N-containing heterocyclic ring include tetrazole ring, triazole ring, oxadiazole ring, thiadiazole ring, imidazole ring, indole ring, oxazole ring, benzoxazole ring, benzthiazole ring, benzoselenazole ring and naphthoxazole ring.

Examples of a halogen atom represented by $R_4$ of formula (3) include fluorine atom, chlorine atom, bromine atom, iodine atom; examples of an alkyl group include methyl, ethyl, propyl, i-propyl, butyl, t-butyl, pentyl, cyclopentyl, hexyl, cyclohexyl, octyl, dodecyl, hydroxyethyl, methoxyethyl, trifluoromethyl, and benzyl; examples of an aryl group include phenyl and naphthyl; examples of an alkylcarbonamido group include acetylamino, propionylamino and butyloylamino; examples of an arylcarbonamido group include benzoylamino; examples of an alkylsulfonamido group include methanesulfonylamino and ethanesulfonylamino; examples of an arylsulfonamido group include benzenesulfonylamino and toluenesulfonylamino; examples of an aryloxy group include phenoxy; examples of an alkylthio group include methylthio, ethylthio and butylthio; examples of an arylthio group include phenylthio and tolylthio; examples of an alkylcarbamoyl group include methylcarbamoyl, dimethylcarbamoyl, ethylcarbamoyl, dimethylcarbamoyl, dibutylcarbamoyl, piperidylcarbamoyl, and morpholylcarbamoyl; examples of an arylcarbamoyl group include phenylcarbamoyl, methylphenylcarbamoyl, ethylphenylcarbamoyl and benzylphenylcarbamoyl; examples of an alkylsulfamoyl group include methylsulfamoyl, dimethylsulfamoyl, ethylsulfamoyl, diethylsulfamoyl, dibutylsufamoyl, piperidylsulfamoyl, and morpholylsulfamoyl; examples of an arylsulfamoyl group include phenylsulfamoyl, methylphenylsulfamoyl, ethylphenylsulfamoyl, and benzylphenylsulfamoyl; examples of an alkylsulfonyl group include methanesulfonyl, and ethanesulfonyl; examples of an arylsulfonyl group include phenylsufonyl, 4-chlorophenylsulfonyl and p-toluenesulfonyl; examples of an alkoxycarbonyl group include methoxycarbonyl, ethoxycarbonyl and butoxycarbonyl; examples of an aryloxycarbonyl group include phenoxycarbonyl; examples of an alkylcarbonyl group include acetyl, propionyl and butyloyl; examples of an arylcarbonyl group include benzoyl, and alkylbenzoyl; examples of an acyloxy group include acetyloxy, propionyloxy and butyloyloxy; examples of heterocyclic group include a oxazole ring, imidazole ring, thiazole ring, triazole ring, selenazole ring, tetrazole ring, oxadiazole ring, thiadiazole ring, thiazine ring, triazine ring, benzoxazole ring, benzthiazole ring, benzimidazole ring, indolenine ring, benzoselenazole ring, naphthothiazole ring, triazaindolizine ring, diazaindolizine ring, and tetrazaindolizine ring. These substituent groups may be substituted by substituent (s).

Preferred examples of the compound represented by formula (3) are shown below but are by no means limited to these examples.

3-1

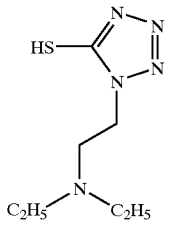

3-2

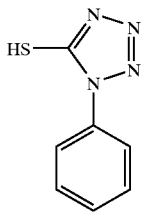

3-3

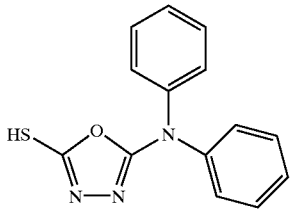

-continued 3-4

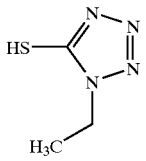

3-5

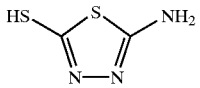

3-6

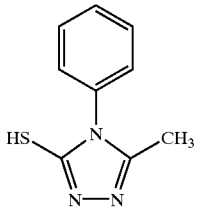

3-7

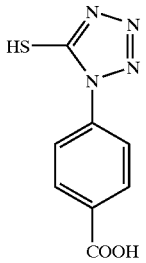

3-8

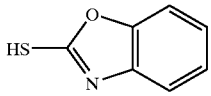

3-9

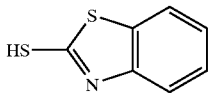

3-10

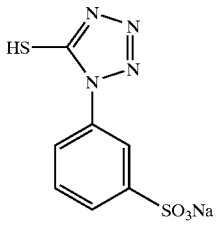

3-11

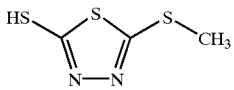

3-12

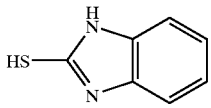

-continued 3-13

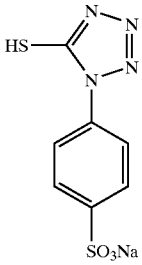

3-14

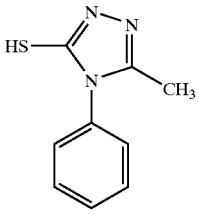

3-15

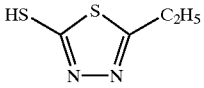

3-16

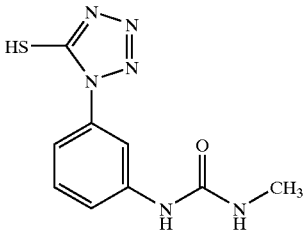

3-17

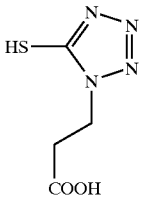

Next formula (4) will be described:

Formula (4)

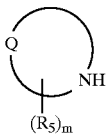

wherein Q represents an atomic group necessary to form a 5- or 6-membered N-containing heterocycric ring; m is an integer of 0 to 5; $R_5$ is a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsufamoyl group, a sulfamoyl group, cyano group, an alkylsulfonyl group, an arylsulfonyl group, an alkoxycarbonyl group, an aryloxycarbonyl group, an alkylcarbonyl group, an arylcarbonyl group, an acyloxy group, carboxy group, carbonyl group, sulfonyl group, an amino group, hydroxy group or a heterocyclic group, provided that when m is 2 or more, plural $R_5$s may be the same or different and may combine with each other to form a ring.

Examples of the N-containing heterocyclic ring include tetrazole ring, triazole ring, imidazole ring, benztriazole, benzimidazole and naphthotriazole.

Examples of a halogen atom represented by $R_5$ of formula (4) include fluorine atom, chlorine atom, bromine atom, iodine atom; examples of an alkyl group include methyl, ethyl, propyl, i-propyl, butyl, t-butyl, pentyl, cyclopentyl, hexyl, cyclohexyl, octyl, dodecyl, hydroxyethyl, methoxyethyl, trifluoromethyl, and benzyl; examples of an aryl group include phenyl and naphthyl; examples of an alkylcarbonamido group include acetylamino, propionylamino and butyloylamino; examples of an arylcarbonamido group include benzoylamino; examples of an alkylsulfonamido group include methanesulfonylamino and ethanesulfonylamino; examples of an arylsulfonamido group include benzenesulfonylamino and toluenesulfonylamino; examples of an aryloxy group include phenoxy; examples of an alkylthio group include methylthio, ethylthio and butylthio; examples of an arylthio group include phenylthio and tolylthio; examples of an alkylcarbamoyl group include methylcarbamoyl, dimethylcarbamoyl, ethylcarbamoyl, dimethylcarbamoyl, dibutylcarbamoyl, piperidylcarbamoyl, and morpholylcarbamoyl; examples of an arylcarbamoyl group include phenylcarbamoyl, methylphenylcarbamoyl, ethylphenylcarbamoyl and benzylphenylcarbamoyl; examples of an alkylsulfamoyl group include methylsulfamoyl, dimethylsulfamoyl, ethylsulfamoyl, diethylsulfamoyl, dibutylsufamoyl, piperidylsulfamoyl, and morpholylsulfamoyl; examples of an arylsulfamoyl group include phenylsulfamoyl, methylphenylsulfamoyl, ethylphenylsulfamoyl, and benzylphenylsulfamoyl; examples of an alkylsulfonyl group include methanesulfonyl, and ethanesulfonyl; examples of an arylsulfonyl group include phenylsufonyl, 4-chlorophenylsulfonyl and p-toluenesulfonyl; examples of an alkoxycarbonyl group include methoxycarbonyl, ethoxycarbonyl and butoxycarbonyl; examples of an aryloxycarbonyl group include phenoxycarbonyl; examples of an alkylcarbonyl group include acetyl, propionyl and butyloyl; examples of an arylcarbonyl group include benzoyl, and alkylbenzoyl; examples of an acyloxy group include acetyloxy, propionyloxy and butyloyloxy; examples of heterocyclic group include a oxazole ring, imidazole ring, thiazole ring, triazole ring, selenazole ring, tetrazole ring, oxadiazole ring, thiadiazole ring, thiazine ring, triazine ring, benzoxazole ring, benzthiazole ring, benzimidazole ring, indolenine ring, benzoselenazole ring, naphthothiazole ring, triazaindolizine ring, diazaindolizine ring, and tetrazaindolizine ring. These substituent groups may be substituted by substituent (s).

Preferred examples of the compound represented by formula (4) are shown below but are by no means limited to these examples.

4-1

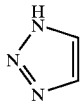

4-2

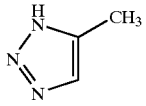

-continued 4-3

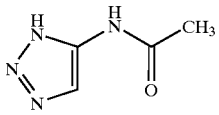

4-4

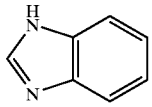

4-5

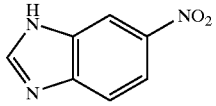

4-6

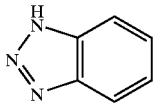

4-7

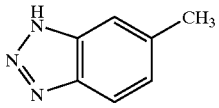

4-8

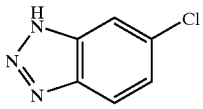

4-9

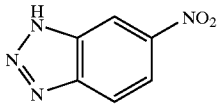

4-10

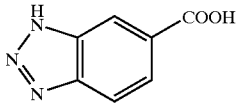

4-11

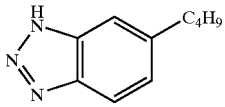

4-12

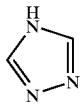

4-13

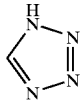

4-14

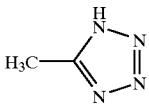

4-15

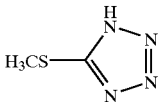

-continued 4-16

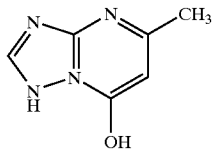

4-17

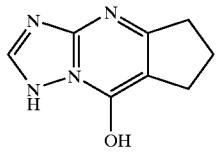

4-18

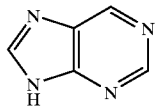

4-19

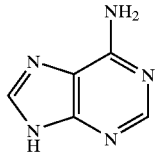

4-20

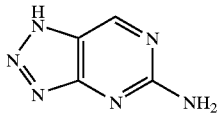

4-21

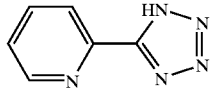

4-22

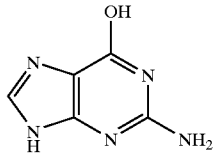

4-23

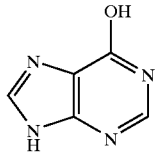

4-24

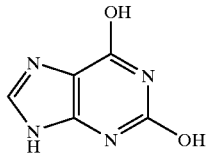

4-25

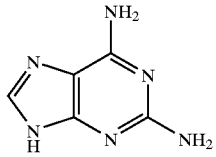

-continued 4-26

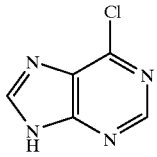

4-27

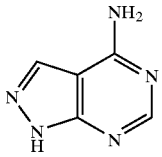

4-28

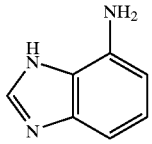

4-29

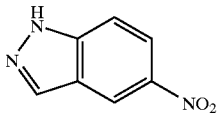

Next, formula (5) will be described:

$$H_2N—R_6 \qquad \text{Formula (5)}$$

wherein $R_6$ is an alkyl group, an aryl group or a heterocyclic group.

Examples of an alkyl group represented by $R_6$ of formula (5) include methyl, ethyl, propyl, i-propyl, butyl, t-butyl, pentyl, cyclopentyl, hexyl, cyclohexyl, octyl, dodecyl, hydroxyethyl, methoxyethyl, trifluoromethyl and benzyl; examples of the aryl group include phenyl and naphthyl; examples of the heterocyclic group include an oxazole ring, imidazole ring, thiazole ring, triazole ring, selenazole ring, tetrazole ring, oxadiazole ring, thiadiazole ring, thiazine ring, triazine ring, benzoxazole ring, benzthiazole ring, benzimidazole ring, indolenine ring, benzoselenazole ring, naphthothiazole ring, triazaindolizine ring, diazaindolizine ring, and tetrazaindolizine ring. These substituent groups may be substituted by substituent group(s).

Preferred examples of the compound represented by formula (5) are shown below but are by no means limited to these examples.

5-1

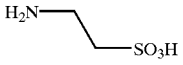

5-2

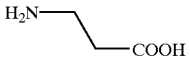

5-3

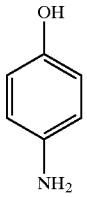

-continued 5-4

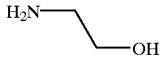

Next, formula (6) will be described:

Formula (6)

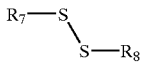

wherein $R_7$ and $R_8$, which may be the same or different are each an alkyl group, aryl group or a heterocyclic group, provided that $R_7$ and $R_8$ may combine with each other to form a ring.

Examples of an alkyl group represented by $R_7$ and $R_8$ of formula (6) include methyl, ethyl, propyl, i-propyl, butyl, t-butyl, pentyl, cyclopentyl, hexyl, cyclohexyl, octyl, dodecyl, hydroxyethyl, methoxyethyl, trifluoromethyl and benzyl; examples of the aryl group include phenyl and naphthyl; examples of the heterocyclic group include an oxazole ring, imidazole ring, thiazole ring, triazole ring, selenazole ring, tetrazole ring, oxadiazole ring, thiadiazole ring, thiazine ring, triazine ring, benzoxazole ring, benzthiazole ring, benzimidazole ring, indolenine ring, benzoselenazole ring, naphthothiazole ring, triazaindolizine ring, diazaindolizine ring, and tetrazaindolizine ring. These substituent groups may be substituted by substituent group(s).

Preferred examples of the compound represented by formula (6) are shown below but are by no means limited to these examples.

6-1

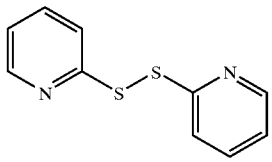

6-2

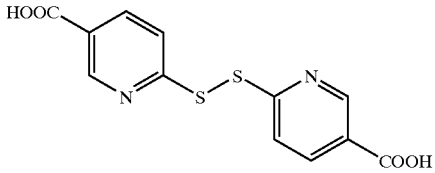

6-3

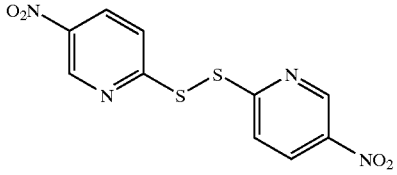

6-4

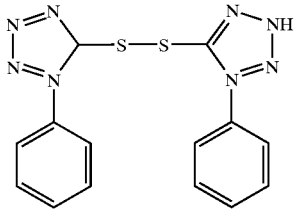

-continued 6-5

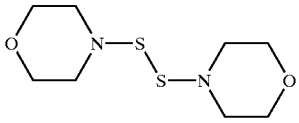

6-6

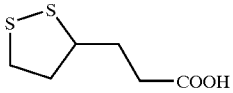

6-7

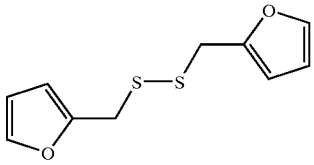

Next, formula (7) will be described:

Formula (7)

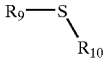

wherein $R_9$ and $R_{10}$, which may be the same or different are each an alkyl group, aryl group or a heterocyclic group, provided that $R_9$ and $R_{10}$ may combine with each other to form a ring.

Examples of an alkyl group represented by $R_9$ and $R_{10}$ of formula (6) include methyl, ethyl, propyl, i-propyl, butyl, t-butyl, pentyl, cyclopentyl, hexyl, cyclohexyl, octyl, dodecyl, hydroxyethyl, methoxyethyl, trifluoromethyl and benzyl; examples of the aryl group include phenyl and naphthyl; examples of the heterocyclic group include an oxazole ring, imidazole ring, thiazole ring, triazole ring, selenazole ring, tetrazole ring, oxadiazole ring, thiadiazole ring, thiazine ring, triazine ring,-benzoxazole ring, benzthiazole ring, benzimidazole ring, indolenine ring, benzoselenazole ring, naphthothiazole ring, triazaindolizine ring, diazaindolizine ring, and tetrazaindolizine ring. These substituent groups may be substituted by substituent group(s).

Preferred examples of the compound represented by formula (7) are shown below but are by no means limited to these examples.

7-1

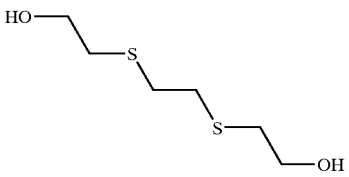

7-2

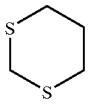

-continued 7-3

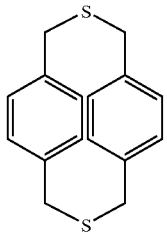

7-4

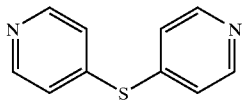

In addition to the foregoing color developing agent, its precursor, base precursor and restraining agent, the aqueous medium for image formation used in the invention may contain a solubilizing agent for a color developing agent, preservative, or wetting agent. Examples of the solubilizing agent for a color developing agent include triethanolamine, polyethylene glycols and p-toluenesulfonic acid described in JP-A No. 8-202003. Examples of the preservative include sodium sulfite and hydroxylamine. Specifically, hydroxylamines represented by the following formula (A) are preferred:

Formula (A)

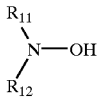

wherein $R_{11}$ and $R_{12}$ are each a hydrogen atom or an alkyl group, provided that $R_{11}$ and $R_{12}$ are not hydrogen atoms at the same time and $R_{11}$ and $R_{12}$ may combine with each other to form a ring. The alkyl groups represented by $R_{11}$ and $R_{12}$, which may be the same or different, preferably are those having 1 to 3 carbon atoms. The alkyl groups represented by $R_{11}$ and $R_{12}$ each may be substituted by a substituent group or may combine with each other to form a ring, for example, a heterocyclic ring such as piperidine or morpholine. The substituent group described above preferably is a sulfonic acid group or an alkoxy group.

The hydroxylamine type compounds represented by formula (A) are described in U.S. Pat. Nos. 3,287,125, 3,293,034 and 3,287,124. Preferred examples thereof are shown below.

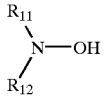

| Compound No. | $R_{11}$ | $R_{12}$ |
|---|---|---|
| A-1 | $-C_2H_5$ | $-C_2H_5$ |
| A-2 | $-CH_3$ | $-CH_3$ |
| A-3 | $-C_3H_7$ | $-C_3H_7$ |
| A-4 | $-C_3H_7$(i) | $-C_3H_7$(i) |
| A-5 | $-CH_3$ | $-C_2H_5$ |
| A-6 | $-C_2H_5$ | $-C_3H_7$(i) |
| A-7 | $-CH_3$ | $-C_3H_7$(i) |
| A-8 | —H | $-C_2H_5$ |
| A-9 | —H | $-C_3H_7$ |

-continued

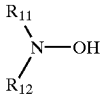

| Compound No. | $R_{11}$ | $R_{12}$ |
|---|---|---|
| A-10 | —H | $-CH_3$ |
| A-11 | —H | $-C_3H_7$(i) |
| A-12 | $-C_2H_5$ | $-C_2H_4OCH_3$ |
| A-13 | $-C_2H_4OH$ | $-C_2H_4OH$ |
| A-14 | $-C_2H_4SO_3H$ | $-C_2H_5$ |
| A-15 | $-C_2H_4COOH$ | $-C_2H_4COOH$ |
| A-16 | 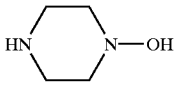 | |
| A-17 | 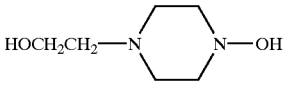 | |
| A-18 | 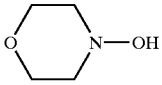 | |
| A-19 | 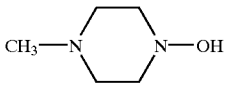 | |
| A-20 | $-CH_3$ | $-C_2H_4OCH_3$ |
| A-21 | $-C_2H_4OCH_3$ | $-C_2H_4OCH_3$ |
| A-22 | $-C_2H_4OC_2H_5$ | $-C_2H_4OC_2H_5$ |
| A-23 | $-C_3H_6OCH_3$ | $-C_3H_6OCH_3$ |
| A-24 | $-C_2H_5$ | $-C_2H_4OC_2H_5$ |
| A-25 | $-C_3H_7$ | $-C_2H_4OCH_3$ |
| A-26 | $-CH_3$ | $-C_2H_4OC_2H_5$ |
| A-27 | $-CH_3$ | $-CH_2OCH_3$ |
| A-28 | $-C_2H_5$ | $-CH_2OC_2H_5$ |
| A-29 | $-CH_2OCH_3$ | $-CH_2OCH_3$ |
| A-30 | $-C_3H_7$ | $-C_2H_4OC_3H_7$ |
| A-31 | $-C_3H_6OC_3H_7$ | $-C_3H_6OC_3H_7$ |
| A-32 | $-CH_2CH_2SO_3H$ | $-CH_2CH_2SO_3H$ |
| A-33 | $-CH_2CH_2PO_3H_7$ | $-CH_2CH_2PO_3H_7$ |
| A-34 | 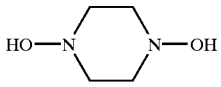 | |
| A-35 | 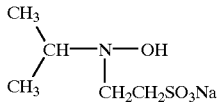 | |

These compounds are usually used in the form of a free amine or a salt, such as hydrochloride, sulfate, p-toluenesulfonate, oxalate, phosphate or acetate.

As a preservative can also be used hydroxylamines described in JP-A No. 8-29924, represented by formula [A]. Examples of the wetting agent include propylene glycol, glycerin and sorbitol.

As a coating aid at the time when the aqueous medium is supplied to the photographic material or processing element, surfactants may be added to the processing element as a coating aid for coating a binder layer. Usable surfactants are not specifically limited and surfactants and coating aids generally used in photographic materials are applicable.

To provide the aqueous medium, a spray system utilizing a gas phase and a coating system are applicable. Examples of the spray system include a system of expelling droplets by vibration of a piezoelectric element (e.g., piezo-type ink jet head), a system of expelling droplets by use of a thermal head employing bumping and a system of spraying liquid employing air pressure or hydrauric pressure. The coating system used in the invention refers to supplying the aqueous medium onto the surface of the photographic material or processing element at a constant rate by a so-called coating system. In this case, it is not allowed to immerse the material in a tank filled with water so as to allow the component to be permeated into the material through diffusion from a bulk solution. Means for supplying processing solution in the coating system include, for example, coating the liquid with a roller and directly supplying liquid, such as curtain coating. Such water-supplying means include, for example, an air doctor coater, a blade coater, a rod coater, a knife coater, a squeeze coater, an impregnation coater, a reverse coater, a transfer coater, a curtain coater, a double roller coater, a slide hopper coater, a gravure coater, a kiss roll coater, a bead coater, a casting coater, a spray coater, a calender coater and an extrusion coater.

To efficiently achieve the objects of the invention, thermal processing is conducted to shorten the processing time. The thermal processing is carried out preferably at a developing temperature of 43 to 95° C., and more preferably 50 to 95° C. Means for heating a photographic material include, for example, a conduction heating means in which a photographic material is brought into contact with a heated drum or heated belt and is heated through thermal conduction, a convection heating means of heating through convection using a dryer or the like, and a radiation heating means of heating through radiation of infrared rays or high frequency electromagnetic waves. In the conduction heating, a heat source is preferably in contact with the back-side of the processing element to avoid adverse effects on the back-side of the photographic material.

In the invention, after the color development stage is completed through the foregoing image forming process, a development stopping treatment may be conducted or not The development stopping treatment includes, for example, addition of acids to the photographic material after completion of development, addition of development restrainers to the photographic material, incorporation of a compound capable of deactivating a color developing agent and incorporation of a compound capable of oxidizing developed silver. To simplify processing, it is advantageous not to conduct the development stopping treatment. For example, it is an effective means that a color development reaction is thermally accelerated and after a sufficiently high image density is obtained, the photographic material is moved to an atmosphere of a relatively low temperature such as room temperature to retard proceeding of the color development reaction to a level having no adverse effect in practice.

To efficiently achieve the objects of the invention, it is effective to read images formed in the photographic material based on the foregoing image forming process, using an image sensor such as a scanner or CCD camera, which converts the images to electric signals. The scanner used in this invention is an apparatus for converting reflection or transmission density obtained by optically scanning a processed photographic material to image information. Scanning the processed photographic material is generally or preferably conducted in such a way that the optical portion of a scanner is allowed to move in a different direction from the moving direction of the processed photographic material. However, the processed photographic material may be fixed and the optical portion of the scanner alone may move; alternatively, the optical portion of the scanner may be fixed and the processed photographic material alone may move. The combination thereof may also be conducted. Image information of the processed photographic material is preferably read in such a manner that at least three lights of different wavelengths, each of which is within the wavelength region of dye absorption, are irradiated overall or by scanning through a slit to measure the reflected or transmitted light. In this case, diffuse light, rather than specular light is more preferable to remove information due to a matting agent or flaws. A semiconductor image sensor (e.g., area-type CCD, CCD line-sensor, etc.) is preferably employed in the receptor section. The processing element may or may not exist in image reading.

To efficiently achieve the objects of the invention, reading formed images without removing silver or a silver compound from the photographic material subjected to color development, i.e., without subjecting the developed photographic material to a bleaching or fixing treatment is effective to simplify the processing or to promptly obtain image information. It is also effective to read image information without peeling off the processing element used in color development from the photographic material.

Any system is applicable for the photographic materials used in the invention, such as a system of forming color through color development with a coupler, a system of color formation by oxidation of leuco dyes, and a system of having a color filter layer and a silver halide layer and obtaining color images without color development.

The photographic material relating to the invention preferably comprises at least a red-sensitive silver halide emulsion layer, green-sensitive silver halide emulsion layer and a blue-sensitive silver halide emulsion layer to record red, green and blue light. The photographic material more preferably comprises at least a red-sensitive silver halide emulsion layer containing a cyan dye forming coupler, green-sensitive silver halide emulsion layer containing a magenta dye forming coupler and a blue-sensitive silver halide emulsion layer containing a yellow dye forming coupler In the photographic materials relating to the invention are usable silver halide emulsions described in Research Disclosure NO. 308119 (hereinafter, also denoted simply as RD308119). Relevant portions are shown below.

| Item | RD 308119 |
|---|---|
| Iodide composition | 993, I-A |
| Preparation method | 993, I-A; 994,I-E |
| Crystal habit (regular crystal) | 993, I-A |
| Crystal habit (twinned crystal) | 993, I-A |
| Epitaxial | 993, I-A |
| Homogeneous halide composition | 993, I-B |
| Inhomogeneous halide composition | 993, I-B |
| Halide conversion | 994, I-C |
| Halide substitution | 994, I-C |
| Metal occlusion | 994, I-D |
| Monodispersibility | 995, I-F |
| Solvent addition | 995, I-F |
| Latent image forming site (surface) | 995, I-G |
| Latent image forming site (internal) | 995, I-G |
| Photographic material (negative) | 995, I-H |
| Photographic material (positive, including internally fogged grains) | 995, I-H |
| Emulsion blending | 995, I-J |
| Desalting | 995, II-A |

The silver halide emulsion according to the invention is subjected to physical ripening, chemical ripening and spectral sensitization. As additives used in these processes are shown compounds described in Research Disclosure No. 17643, No. 18716 and No. 308119 (hereinafter, denoted as RD 17643, RD 18716 and RD 308119), as below.

| Item | RD 308119 | RD 17643 | RD 18716 |
|---|---|---|---|
| Chemical Sensitizer | 996, III-A | 23 | 648 |
| Spectral Sensitizer | 996, IV-A-A, B, C, D, H, I ,J | 23–24 | 648–9 |
| Super Sensitizer | 996, IV-A-E, J | 23–24 | 648–9 |
| Antifoggant | 998, VI | 24–25 | 649 |
| Stabilizer | 998, VI | 24–25 | 649 |

Photographic additives usable in the invention are also described, as below.

| Item | RD 308119 | RD 17643 | RD 18716 |
|---|---|---|---|
| Anti-staining agent | 1002, VII-I | 25 | 650 |
| Dye Image-Stabilizer | 1001, VII-J | 25 | |
| Britening Agent | 998, V | 24 | |
| U.V. Absorbent | 1003, VIII-I, XIII-C | 25–26 | |
| Light Absorbent | 1003, VIII | 25–26 | |
| Light-Scattering Agent | 1003, VIII | | |
| Filter Dye | 1003, VIII | 25–26 | |
| Binder | 1003, IX | 26 | 651 |
| Anti-Static Agent | 1006, XIII | 27 | 650 |
| Hardener | 1004, X | 26 | 651 |
| Plasticizer | 1006, XII | 27 | 650 |
| Lubricant | 1006, XII | 27 | 650 |
| Surfactant, Coating aid | 1005, XI | 26–27 | 650 |
| Matting Agent | 1007, XVI | | |
| Developing Agent (incorporated in photographic material) | 1001, XXB | | |

A variety of couplers can be employed in the invention and examples thereof are described in research Disclosures described above. Relevant description portions are shown below.

| Item | RD 308119 | RD 17643 |
|---|---|---|
| Yellow coupler | 1001, VII-D | VII-C~G |
| Magenta coupler | 1001, VII-D | VII-C~G |
| Cyan coupler | 1001, VII-D | VII-C~G |
| Colored coupler | 1002, VII-G | VII-G |
| DIR coupler | 1001, VII-F | VII-F |
| BAR coupler | 1002, VII-F | |
| PUG releasing coupler | 1001, VII-F | |
| Alkali-soluble coupler | 1001, VII-E | |

Additives used in the invention can be added by dispersion techniques described in RD 308119 XIV. In the invention are employed supports described in RD 17643, page 28; RD 18716, page 647–648; and RD 308119 XIX. In the photographic material relating to the invention, there can be provided auxiliary layers such as a filter layer and interlayer, as described in RD 308119 VII-K, and arranged in a variety of layer orders such as normal layer order, reverse layer order and a unit layer arrangement.

In cases when the photographic material relating to the invention is used in a roll form, it is preferred to adopt a form of housing it in a cartridge. The cartridge that is most popular at the present time is a 135 format or IX-240 format cartridge. There are also usable cartridges proposed in Japanese Utility Model Application No. 58-67329; JP-A Nos. 58-181835, 58-182634; Japanese Utility Model Application No. 58-195236; U.S. Pat. No. 4,221,479; Japanese Patent Application Nos. 63-57785, 63-183344, 63-325638, 1-21862, 1-25362, 1-30246, 1-20222, 1-218631-37181, 1-33108, 1-851981, 1-172595, 1-172594, 1-172593; and U.S. Pat. Nos. 4,846,418, 4,848,693 and 4,832,275.

Next, film cartridges housing photographic material will be described. The main material of cartridges used in the invention may be metals or synthetic plastic resins. Preferred examples of plastic resin material include polystyrene, polypropylene and polyphenyl ether. The cartridge may contain various antistatic agents; and carbon black, metal oxide particles, nonionic, anionic, cationic or betaine-type surfactants are preferable. Static-free cartridges are described in JP-A 1-312537 and 1-312538 and those which exhibit a resistance of 1012Ω or less at 25° C. and 25% RH are specifically preferred. Conventionally used plastic resin cartridges are made by compounding carbon black or pigments for light-tightness. The cartridge size may be the same as the present 135-size. Alternatively, to make the camera format still smaller, it is useful to make the 25 mm cartridge diameter of the present 135-size 22 mm or less. The volume of the cartridge case is preferably not more than 30 $cm^3$, and more preferably not more than 25 $cm^3$. The weight of plastic resin used in the cartridge or its case is preferably 5 to 15 g. A cartridge in which film is delivered by a rotating spur is also usable. A structure is also feasible, in which the top of the film is housed within a cartridge and the film top is delivered from the port portion of the cartridge to the outside by rotating the spur shaft in the direction of film delivery. These are disclosed in U.S. Pat. Nos. 4,834,306 and 5,226,613.

The photographic material relating to the invention may be housed in a commercially available lens-fitted film unit. It is also preferable to load the photographic material into the lens-fitted film unit described in Japanese Patent Application Nos. 10158427, 10-170624 and 10-188984.

EXAMPLES

The present invention will be further described based on examples but the invention is by no means limited to these embodiments.

Example 1

Preparation of Photographic Material

The following layers containing composition as shown below were formed on a subbed triacetyl cellulose film support to prepare a photographic material. The addition amount of each compound was represented in term of $g/m^2$, provided that the amount of silver halide or colloidal silver was converted to the silver amount and the amount of a sensitizing dye (denoted as "SD") was represented in mol/Ag mol.

| | |
|---|---|
| 1st Layer: Anti-Halation Layer | |
| Black colloidal silver | 0.20 |
| UV-1 | 0.30 |
| CM-1 | 0.040 |
| OIL-1 | 0.167 |
| Gelatin | 1.33 |
| 2nd Layer: Intermediate Layer | |
| CM-1 | 0.10 |
| OIL-1 | 0.06 |
| Gelatin | 0.67 |

-continued

| 3rd Layer: Low-speed Red-Sensitive Layer | |
|---|---|
| Silver iodobromide emulsion a | 0.298 |
| Silver iodobromide emulsion b | 0.160 |
| SD-1 | $2.4 \times 10^{-5}$ |
| SD-2 | $9.6 \times 10^{-5}$ |
| SD-3 | $2.0 \times 10^{-4}$ |
| SD-4 | $8.9 \times 10^{-5}$ |
| SD-5 | $9.2 \times 10^{-5}$ |
| C-1 | 0.56 |
| CC-1 | 0.046 |
| OIL-2 | 0.35 |
| AS-2 | 0.001 |
| Gelatin | 1.35 |
| **4th Layer: Medium-speed Red-sensitive Layer** | |
| Silver iodobromide emulsion c | 0.314 |
| Silver iodobromide emuision d | 0.157 |
| SD-1 | $2.5 \times 10^{-5}$ |
| SD-2 | $5.6 \times 10^{-5}$ |
| SD-3 | $1.2 \times 10^{-4}$ |
| SD-4 | $2.0 \times 10^{-4}$ |
| SD-5 | $2.2 \times 10^{-4}$ |
| C-1 | 0.36 |
| CC-1 | 0.052 |
| DI-1 | 0.022 |
| OIL-2 | 0.22 |
| AS-2 | 0.001 |
| Gelatin | 0.82 |
| **5th Layer: High-speed Red-Sensitive Layer** | |
| Silver iodobromide emulsion c | 0.094 |
| Silver iodobromide emulsion d | 0.856 |
| SD-1 | $3.6 \times 10^{-5}$ |
| SD-4 | $2.5 \times 10^{-4}$ |
| SD-5 | $2.0 \times 10^{-4}$ |
| C-2 | 0.17 |
| C-3 | 0.088 |
| CC-1 | 0.041 |
| DI-4 | 0.012 |
| OIL-2 | 0.16 |
| AS-2 | 0.002 |
| Gelatin | 1.30 |
| **6th Layer: Intermediate Layer** | |
| OIL-1 | 0.20 |
| AS-1 | 0.16 |
| Gelatin | 0.89 |
| **7th Layer: Low-speed Green-Sensitive Layer** | |
| Silver iodobromide emulsion a | 0.19 |
| Silver iodobromide emulsion d | 0.19 |
| SD-6 | $1.2 \times 10^{-4}$ |
| SD-7 | $1.1 \times 10^{-4}$ |
| M-1 | 0.26 |
| CM-1 | 0.070 |
| OIL-1 | 0.35 |
| DI-2 | 0.007 |
| Gelatin | 1.10 |
| **8th Layer: Medium-speed Green-Sensitive Layer** | |
| Silver iodobromide emulsion c | 0.41 |
| Silver iodobromide emulsion d | 0.19 |
| SD-6 | $7.5 \times 10^{-5}$ |
| SD-7 | $4.1 \times 10^{-4}$ |
| SD-8 | $3.0 \times 10^{-4}$ |
| SD-9 | $6.0 \times 10^{-5}$ |
| SD-10 | $3.9 \times 10^{-5}$ |
| M-1 | 0.05 |
| M-4 | 0.11 |
| CM-1 | 0.024 |
| CM-2 | 0.028 |
| DI-3 | 0.001 |
| DI-2 | 0.010 |
| OIL-1 | 0.22 |
| AS-2 | 0.001 |
| Gelatin | 0.80 |

-continued

| 9th Layer: High-speed Green-Sensitive Layer | |
|---|---|
| Silver iodobromide emulsion a | 0.028 |
| Silver iodobromide emulsion e | 0.49 |
| SD-6 | $5.5 \times 10^{-6}$ |
| SD-7 | $5.2 \times 10^{-5}$ |
| SD-8 | $4.3 \times 10^{-4}$ |
| SD-10 | $2.6 \times 10^{-5}$ |
| SD-11 | $1.3 \times 10^{-4}$ |
| M-1 | 0.068 |
| CM-2 | 0.015 |
| DI-3 | 0.029 |
| OIL-1 | 0.14 |
| OIL-3 | 0.13 |
| AS-2 | 0.001 |
| Gelatin | 1.00 |
| **10th Layer: Yellow Filter Layer** | |
| Yellow colloidal silver | 0.06 |
| OIL-1 | 0.18 |
| AS-1 | 0.14 |
| Gelatin | 0.90 |
| **11th Layer: Low-speed Blue-sensitive Layer** | |
| Silver iodobromide emulsion d | 0.11 |
| Silver iodobromide emulsion a | 0.15 |
| Silver iodobromide emulsion h | 0.11 |
| SD-12 | $1.0 \times 10^{-4}$ |
| SD-13 | $2.0 \times 10^{-4}$ |
| SD-14 | $1.6 \times 10^{-4}$ |
| SD-15 | $1.3 \times 10^{-4}$ |
| Y-1 | 0.71 |
| DI-3 | 0.016 |
| AS-2 | 0.001 |
| OIL-1 | 0.22 |
| Gelatin | 1.38 |
| **12th Layer: High-speed Blue-sensitive Layer** | |
| Silver iodobromide emulsion h | 0.31 |
| Silver iodobromide emulsion i | 0.56 |
| SD-12 | $7.5 \times 10^{-5}$ |
| SD-15 | $4.0 \times 10^{-4}$ |
| Y-1 | 0.26 |
| DI-4 | 0.054 |
| AS-2 | 0.001 |
| OIL-1 | 0.13 |
| Gelatin | 1.06 |
| **13th Layer: First Protective Layer** | |
| Silver iodobromide emulsion j | 0.20 |
| UV-1 | 0.11 |
| UV-2 | 0.055 |
| OIL-3 | 0.20 |
| Gelatin | 1.00 |
| **14th Layer: Second protective Layer** | |
| PM-1 | 0.10 |
| PPM-2 | 0.018 |
| WAX-1 | 0.020 |
| SU-1 | 0.002 |
| SU-2 | 0.002 |
| Gelatin | 0.55 |

Characteristics of silver iodobromide emulsions described above are shown below, in which the average grain size refers to an edge length of a cube having the same volume as that of the grain.

| Emulsion No. | Av. grain size (μm) | Av. AgI content (mol %) | Diameter/thickness ratio | Coefficient of variation (%) |
|---|---|---|---|---|
| a | 0.27 | 2.0 | 1.0 | 15 |
| b | 0.42 | 4.0 | 1.0 | 17 |
| c | 0.56 | 3.8 | 4.5 | 25 |
| d | 0.38 | 8.0 | 1.0 | 15 |

-continued

| Emulsion No. | Av. grain size (μm) | Av. AgI content (mol %) | Diameter/thickness ratio | Coefficient of variation (%) |
|---|---|---|---|---|
| e | 0.87 | 3.8 | 5.0 | 21 |
| f | 0.30 | 1.9 | 6.4 | 25 |
| g | 0.44 | 3.5 | 5.5 | 25 |
| h | 0.60 | 7.7 | 3.0 | 18 |
| i | 1.00 | 7.6 | 4.0 | 15 |
| j | 0.05 | 2.0 | 1.0 | 30 |

With regard to the foregoing emulsions, except for emulsion j, after adding the foregoing sensitizing dyes to each of the emulsions, triphenylphosphine selenide, sodium thiosulfate, chloroauric acid and potassium thiocyanate were added and chemical sensitization was conducted according to the commonly known method until relationship between sensitivity and fog reached an optimum point.

In addition to the above composition were added coating aids SU-3; a dispersing aid SU-4, viscosity-adjusting agent V-1, stabilizers ST-1 and ST-2; fog restrainer AF-1 and AF-2 comprising two kinds polyvinyl pyrrolidone of weight-averaged molecular weights of 10,000 and 1.100,000; inhibitors AF-3, AF-4 and AF-5; hardener H-1 and H-2; and antiseptic Ase-1.

Chemical structure for each of the compounds used in the foregoing sample are shown below.

Y-1

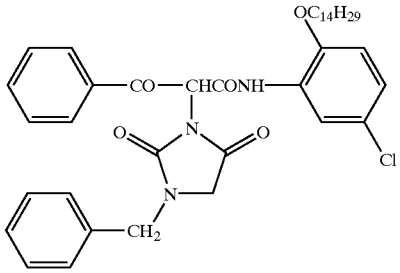

M-1

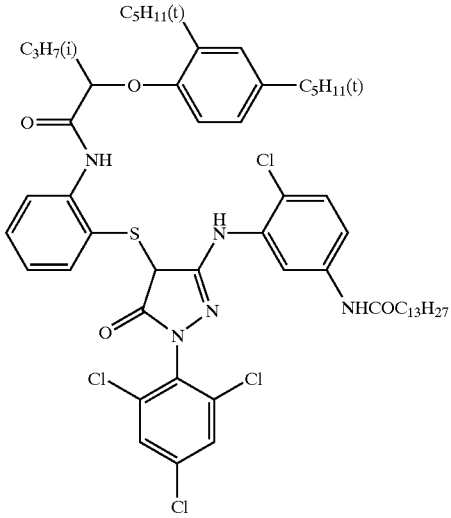

M-2

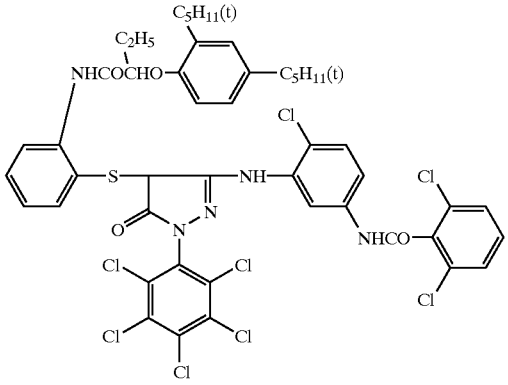

M-3

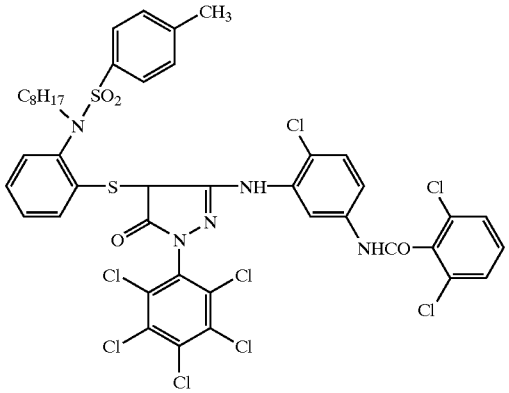

M-4

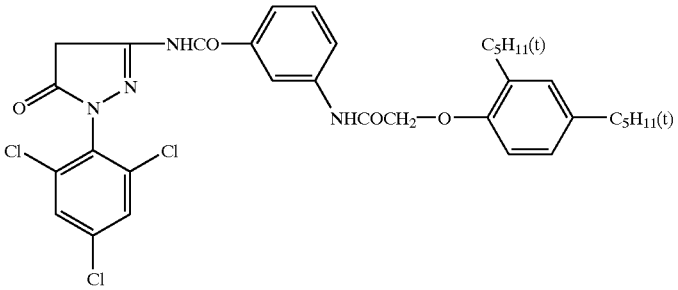

-continued
C-1
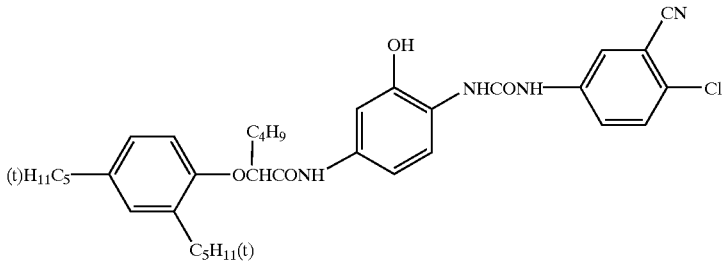
C-2
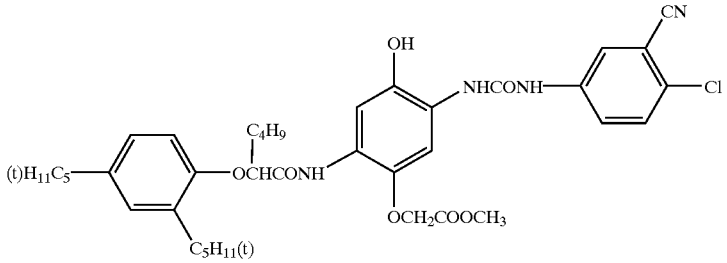
C-3
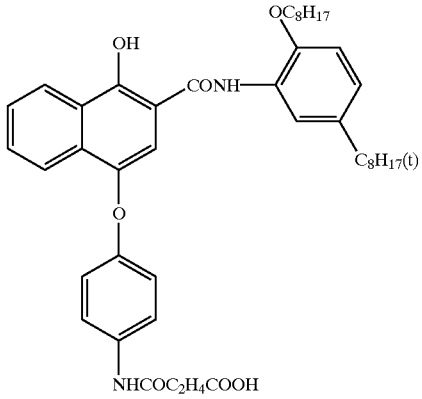
CC-1
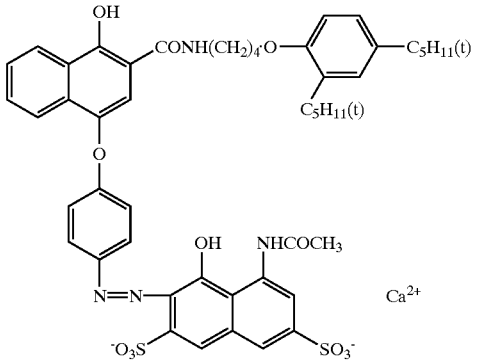
CM-1
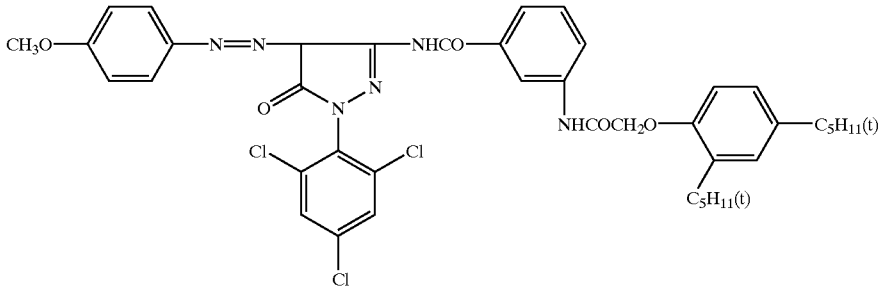
CM-2
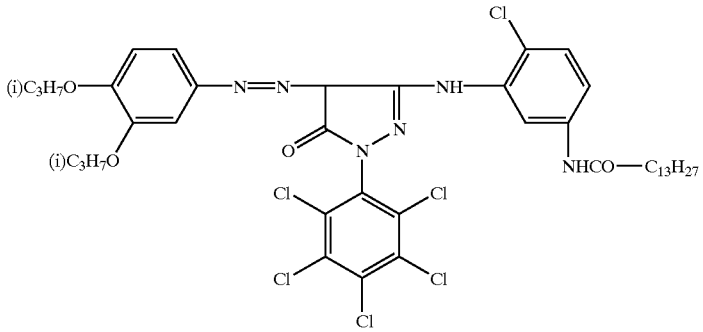

-continued
DI-1
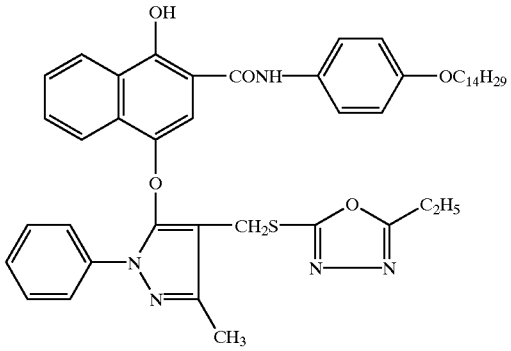
DI-2
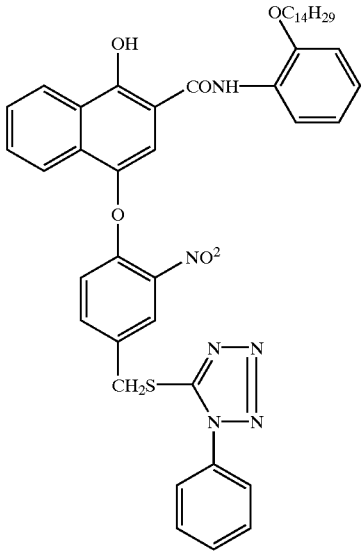
DI-3
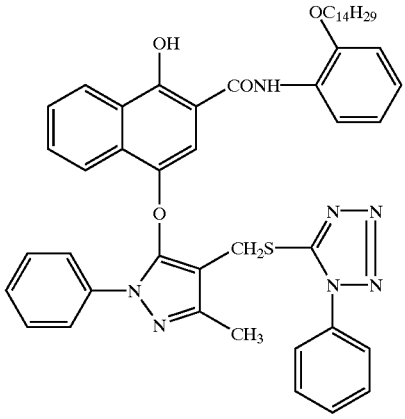
DI-4
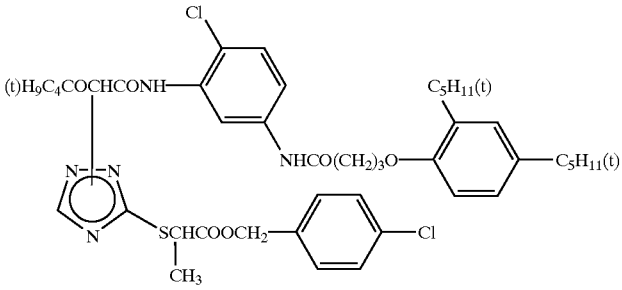
AS-1
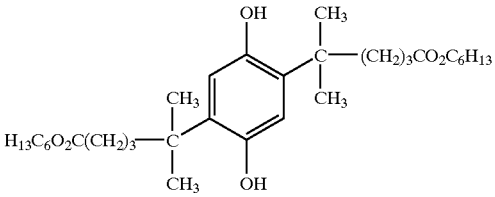
AS-2
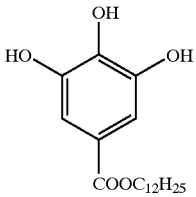

-continued
AS-3
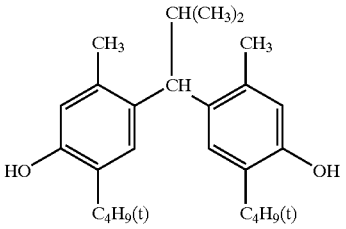
AS-4
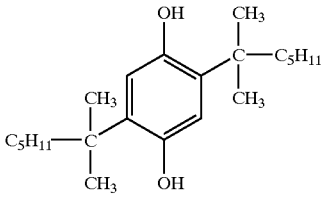
OIL-1
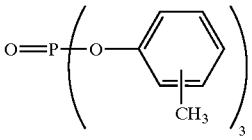
UV-1
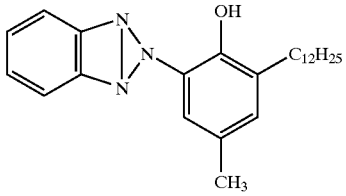
OIL-2
$H_9C_4OOC(CH_2)_8COOC_4H_9$
OIL-3
Liquid paraffin
UV-2
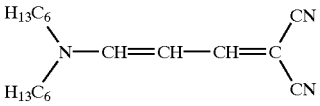
V-1
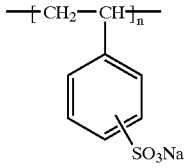
n: Degree of polymerization
Ase-1 (Mixture)
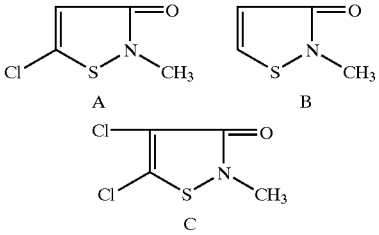
A:B:C = 50:46:4
H-1
$CH_2{=}CHSO_2{-}CH_2CONHC_2H_4NHCOCH_2{-}SO_2CH{=}CH_2$
H-2
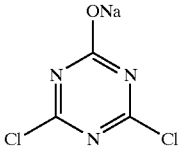
SD-1
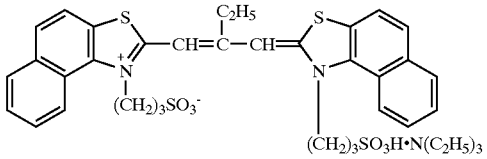
SD-2
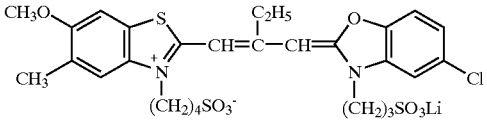
SD-3
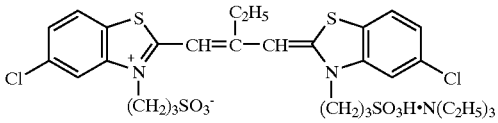
SD-4
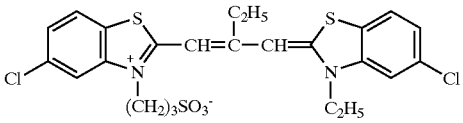
SD-5
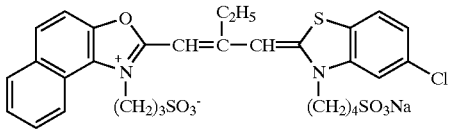
SD-6
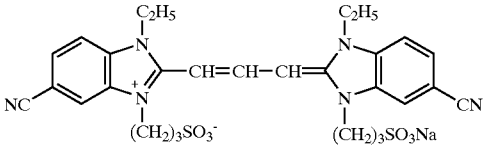
SD-7
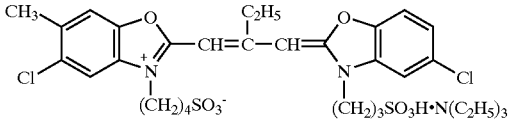

-continued
SD-8
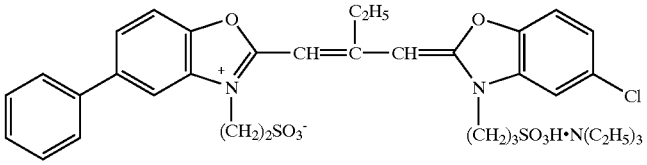
SD-9
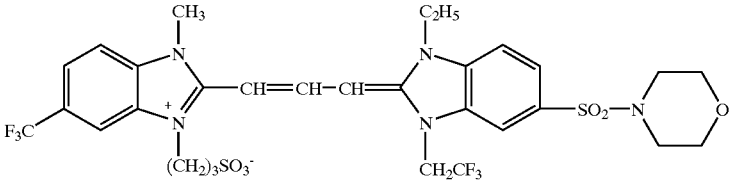
SD-10
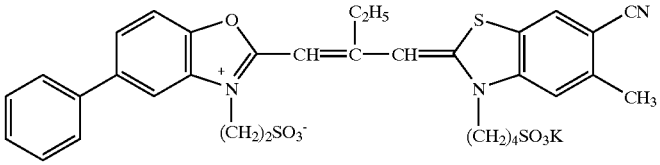
SD-11
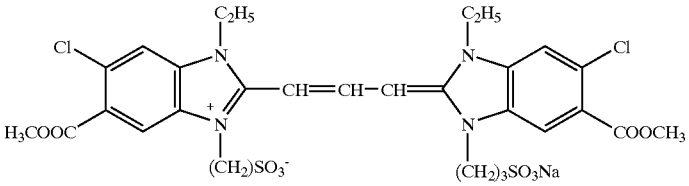
SD-12
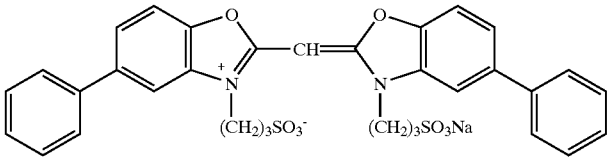
SD-13
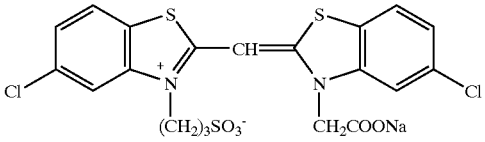
SD-14
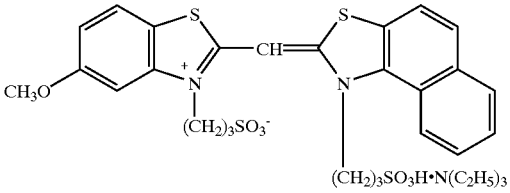
SD-15
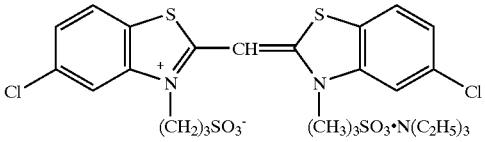
ST-1
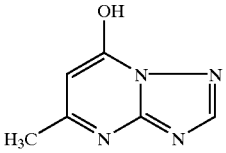
ST-2
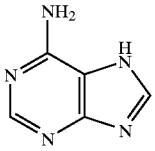
AF-1, 2
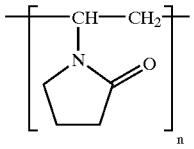
AF-1 Mw ≒ 10,000
AF-2 Mw ≒ 100,000
n: Degree of polymerization
AF-3
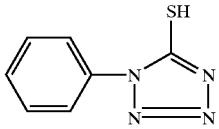
AF-4
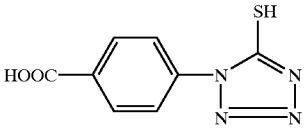

-continued

AF-5

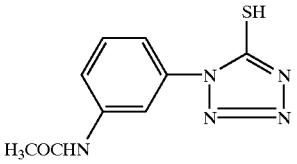

X-1

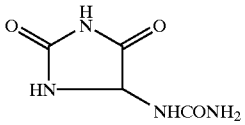

SU-1

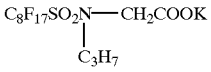

SU-2

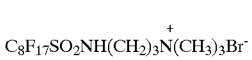

SU-3

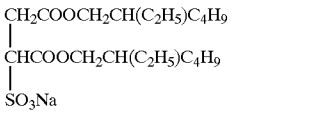

SU-4

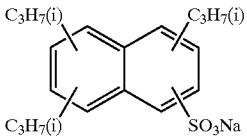

WAX-1

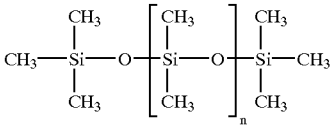

Mw = 3,000

PM-1

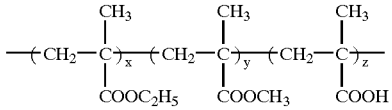

x:y:z = 3:3:4

PM-2

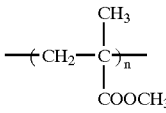

n: Degree of polymerization

The thus prepared photographic material sample 1 was exposed to white light at 1000 lux for 1/100 sec, through an optical wedge interposed between the photographic material and the light source.

Next, a processing element and processing solutions were prepared.

Preparation of Processing Element No. 1

Aqueous 20% gelatin solution was adjusted tp a pH of 6.5 and a dispersion of zinc oxide having an average particle size of 200 $\mu$m was added thereto with stirring. On a 85 $\mu$m thick transparent PEN support, the thus prepared solution was coated by casting so as to have a zinc oxide coverage of 4.5 g/m$^2$, then, was allowed to stand under conditions of 23° C. and 50% RH for 10 hrs. and was further aged in an atmosphere of 400° C. and 80% RH for 14 hrs. On the transparent PEN support, a 10 $\mu$m thick gelatin layer containing zinc oxide was formed, having a gelatin coverage of 12 g/m$^2$.

| Preparation of Aqueous Medium No. 1 used for Image Formation | |
|---|---|
| Carboxymethyl cellulose | 3.0 g |
| Adenine | 0.5 g |
| Sodium sulfite | 0.33 g |
| Disulfoethylhydroxylamine (A-25) | 1.00 g |
| 2-Methyl-4-{N-ethyl-N-(-hydroxyethyl-amino}aniline sulfate (hereinafter, denoted as CD-1) | 2.63 g |
| Sodium picolinate | 14.0 g |
| TORITON X-200 (available from UNION CARBIDE Co.) | 0.55 g |
| Water | 60 g |

The foregoing mixture was dissolved, then, adjusted to a pH of 6.0 at 25° C. using aqueous 30% sodium hydroxide and aqueous 10% sulfuric acid and water was added thereto to make 100 ml. The thus prepared aqueous medium 1 exhibited a viscosity of 30 centi-poise (cp).

Preparation of Aqueous Medium No. 2a through 2k

Aqueous medium Nos. 2a through 2k were prepared similarly to aqueous medium 1, except that after dissolving the mixture, the pH at 25° C. was adjusted to 3.5, 4.0, 5.0, 7.0, 8.0, 9.0, 9.5, 10.0, 10.5, 11.0, and 12.0, respectively, using aqueous 30% sodium hydroxide and aqueous 10% sulfuric acid.

Process A

On the gelatin layer side of processing element No. 1, each of the thus prepared aqueous mediums was coated by a blade coater in a thickness of 100 $\mu$m and further thereon, the photographic material was placed so as to allow the emulsion layer side of the exposed photographic material 1 to face to the processing element, subsequently, thermal development was carried out at 70° C. for 90 sec or 120 sec. using a heated drum. After completion of thermal development, the processing element was peeled off from the photographic material and the photographic material having black wedge-wise images were obtained.

Process B

Comparative Processing

Photographic material 1, which was exposed similarly to the foregoing, was processed according to the following steps:

| | | |
|---|---|---|
| Color development | 38° C. | 3 min. 15 sec. |
| Bleaching | 38° C. | 6 min. 30 sec. |
| Washing | 38° C. | 30 sec. |
| Fixing | 38° C. | 6 min. 30 sec. |
| Washing | 38° C. | 3 min. 15 sec. |
| Drying | 60° C. | 1 min. 30 sec. |

In the foregoing steps, the following color developer solution, bleach solution and fixer solution were prepared and used.

| Color developer solution | |
|---|---|
| Water | 800 ml |
| Potassium carbonate | 30 g |
| Sodium hydrogen carbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| CD-1 | 2.63 g |
| Diethylenetetraaminepentaacetic acid | 3.0 g |
| Potassium hydroxide | 1.2 g |

Water was added to make 1 lit. and the pH was adjusted to 10.06 with potassium hydroxide or 20% sulfuric acid.

-continued

| Bleach solution | |
|---|---|
| Water | 800 ml |
| Ammonium 1,3-diaminopropanetetraacetate | 125 g |
| Ethylenediaminetetraacetic acid | 2 g |
| Sodium nitrate | 40 g |
| Ammonium bromide | 150 g |
| Glacial acetic acid | 40 g |

Water was added to make 1 lit. and the pH was adjusted to 4.4 with aqueous ammonia or glacial acetic acid.

| Fixer solution | |
|---|---|
| Water | 800 ml |
| Ammonium thiocyanate | 120 g |
| Ammonium thiosulfate | 150 g |
| Sodium sulfite | 15 g |
| Ethylenediaminetetraacetic acid | 2 g |

Water was added to make 1 lit. and the pH adjusted to 6.2 with aqueous ammonia or glacial acetic acid.

Thus processed photographic material samples were subjected to densitometry using a densitometer produced by X-rite Corp. to measure transmission densities with respect to green light. Maximum density (Dmax), minimum density (Dmin) and sensitivity (reciprocal of exposure giving a density of 0.3 above the minimum density) were determined from the characteristic curve [plotted on logarithmic exposure (log E) as abscissa and transmission density (D) as ordinate], which was obtained by making corrections for the base-line density (i.e., the density of an unprocessed sample was subtracted).

Results are shown in Table 1. Sensitivity (S) was represented by a relative value, based on the sensitivity of a sample processed in the process B being 100.

Furthermore, photographic material samples processed in the process A were also evaluated with respect to Uniformity in processing, based on the following criteria:

A: no unevenness was observed

B: slight unevenness was observed

C: marked unevenness was observed.

Results thereof are also shown in Table 1.

TABLE 1

| | Processing Element | Aqueous Medium | | Processing of 90 sec. | | | | Processing of 120 sec. | | | |
|---|---|---|---|---|---|---|---|---|---|---|---|
| Process | No. | No. | pH | Dmin | Dmax | S | Uniformity | Dmin | Dmax | S | Uniformity |
| A | 1 | 1 | 6.0 | 0.18 | 1.79 | 87 | A | 0.25 | 2.16 | 98 | A |
| A | 1 | 2a | 3.5 | 0.08 | 0.67 | 25 | C | 0.13 | 0.84 | 46 | C |
| A | 1 | 2b | 4.0 | 0.10 | 0.75 | 39 | B | 0.18 | 1.25 | 57 | B |
| A | 1 | 2c | 5.0 | 0.16 | 1.62 | 78 | A | 0.19 | 1.97 | 94 | A |
| A | 1 | 2d | 7.0 | 0.24 | 1.98 | 93 | A | 0.36 | 2.36 | 102 | A |
| A | 1 | 2e | 8.0 | 0.29 | 2.09 | 97 | A | 0.43 | 2.54 | 105 | B |
| A | 1 | 2f | 9.0 | 0.47 | 2.25 | 105 | B | 0.74 | 2.71 | 97 | B |
| A | 1 | 2g | 9.5 | 0.59 | 2.44 | 101 | B | 0.90 | 2.76 | 93 | B |
| A | 1 | 2h | 10.0 | 0.63 | 2.46 | 98 | B | 0.91 | 2.79 | 93 | B |
| A | 1 | 2i | 10.5 | 0.64 | 2.49 | 98 | B | 0.96 | 2.85 | 90 | B |
| A | 1 | 2j | 11.0 | 0.68 | 2.55 | 92 | B | 0.98 | 2.89 | 88 | B |
| A | 1 | 2k | 12.0 | 1.13 | 2.58 | 74 | C | 1.35 | 2.88 | 61 | C |

Sensitivity (S), Dmin and Dmax obtained in process B were as follows: S = 100, Dmin = 0.56 and Dmax = 2.68.

As can be seen from Table 1, the image forming process of the invention resulted in images at a relatively high Dmax and enhanced sensitivity, even when processed for a short period of 90 to 120 sec. The aqueous medium for image formation, according to the invention can be employed within a broad range of pH, and processing thereof can be conducted at a pH lower than that of conventional color development (such as process B). To allow enhanced sensitivity and high Dmax to be compatible with low Dmin, the pH of the aqueous medium is preferably 4 to 11.0. It is also preferred to use an aqueous medium having a pH of 4.0 to 11.0, in terms of minimizing unevenness in processing. In cases when using an aqueous medium having a pH of not less than 9.5, although Dmin increased at a processing time of 120 sec., relatively low Dmin and superior discrimination were achieved at a processing time of 90 sec.

Furthermore, even when using aqueous mediums similar to the foregoing aqueous mediums, except that 0.5 g of adenine was replaced by 2.5 g of potassium bromide, results similar to the foregoing were achieved by optimal adjustment of developing temperature and time in the foregoing process A.

Example 2

Preparation of Processing Element No. 2

Processing element No. 2 was prepared similarly to processing element No. 1 of Example 1, except that zinc oxide was not incorporated.

Preparation of Aqueous Medium No. 9

Aqueous medium No. 9, used for image formation was prepared similarly to aqueous medium No. 1 of Example 1, except that sodium picolinate was not incorporated and after the mixture was dissolved, the pH was adjusted to 10 at 25° C. using aqueous 30% sodium hydroxide solution.

Preparation of Aqueous Medium No. 10a and 10b

Aqueous medium No. 10a and 10b were prepared similarly to aqueous medium No. 9, except that the pH was adjusted to 12 and 13, respectively.

Thermal development was carried out similarly to process A of Examples 1, except that processing element No. 1 was replaced by processing element No. 2 and aqueous medium No. 1 and 2a through 2k were replaced by aqueous mediums shown in Table 2. The thus processed samples were evaluated similarly to Example 1 and results thereof are shown in Table 2.

TABLE 2

| Processing Element | Aqueous Medium | | Processing of 90 sec. | | | | Processing of 120 sec. | | | |
|---|---|---|---|---|---|---|---|---|---|---|
| No. | No. | pH | Dmin | Dmax | S | Uniformity | Dmin | Dmax | S | Uniformity |
| 1 | 1 | 6.0 | 0.18 | 1.79 | 87 | A | 0.25 | 2.16 | 98 | A |
| 1 | 2e | 8.0 | 0.29 | 2.09 | 97 | A | 0.43 | 2.54 | 105 | B |
| 1 | 2h | 10.0 | 0.63 | 2.46 | 98 | B | 0.91 | 2.79 | 93 | B |
| 1 | 2k | 12.0 | 1.13 | 2.58 | 74 | C | 1.35 | 2.88 | 61 | C |
| 2 | 9 | 10.0 | 0.21 | 1.34 | 72 | B | 0.35 | 1.69 | 87 | B |
| 2 | 10a | 12.0 | 0.48 | 1.98 | 82 | C | 0.71 | 2.07 | 91 | C |
| 2 | 10b | 13.0 | 0.66 | 2.08 | 76 | C | 1.05 | 2.14 | 78 | C |

As is apparent from Table 2, it was proved that in case when alkali was directly added in place of using a base precursor such as zinc oxide or sodium picolate used in Example 1, sufficiently high image densities were obtained only by increasing a pH value to 12 to 13. In such a case, there were also produced disadvantages that Dmin increased and unevenness in processing tended to occur. As is also apparent from Table 2, in the case of using a base precursor, sufficiently high image densities were obtained even when using an aqueous medium for image formation of a pH of 11 or less and of high safety.

Furthermore, when using aqueous mediums similar to the foregoing aqueous mediums, except that 0.5 g of adenine was replaced by bromide, results similar to the foregoing were achieved optimally adjusting developing temperature and time in the foregoing process A.

Example 3

Preparation of Aqueous Medium No. 11a to 11h and 12a to 12h

Aqueous medium No. 11a to 11h for image formation were prepared similarly to aqueous medium No. 1, except that the kind of carboxymethyl cellulose and its amount were varied to vary the viscosity of the aqueous medium. The measured viscosity is shown in table 3a. Aqueous medium No. 12a through 12h were prepared similarly to aqueous medium No. 2h, except that the kind of carboxymethyl cellulose and its amount were varied to vary the viscosity of the aqueous medium. The measured viscosity is shown in Table 3b.

TABLE 3a

| Processing | Aqueous Medium | | | Processing (70° C., 90 sec.) | | | |
|---|---|---|---|---|---|---|---|
| Element No. | No. | Viscosity (cp) | pH | Dmin | Dmax | S | Uniformity |
| 1 | 1 | 30 | 6.0 | 0.18 | 1.79 | 87 | A |
| 1 | 11a | 1.5 | 6.0 | 0.20 | 1.90 | 95 | C |
| 1 | 11b | 10.1 | 6.0 | 0.19 | 1.98 | 92 | B |
| 1 | 11c | 15.3 | 6.0 | 0.22 | 1.91 | 89 | A |
| 1 | 11d | 20.9 | 6.0 | 0.20 | 1.75 | 96 | A |
| 1 | 11e | 980 | 6.0 | 0.16 | 1.57 | 84 | A |
| 1 | 11f | 2910 | 6.0 | 0.14 | 1.39 | 81 | B |
| 1 | 11g | 14600 | 6.0 | 0.12 | 1.21 | 70 | B |
| 1 | 11h | 21000 | 6.0 | 0.09 | 0.67 | 57 | B |

TABLE 3b

| Processing | Aqueous Medium | | | Processing (55° C., 105 sec.) | | | |
|---|---|---|---|---|---|---|---|
| Element No. | No. | Viscosity (cp) | pH | Dmin | Dmax | S | Uniformity |
| 1 | 2h | 30 | 10.0 | 0.17 | 2.73 | 119 | B |
| 1 | 12a | 9.6 | 10.0 | 0.18 | 2.90 | 124 | C |
| 1 | 12b | 110 | 10.0 | 0.17 | 2.72 | 120 | A |
| 1 | 12c | 540 | 10.0 | 0.18 | 2.68 | 110 | A |
| 1 | 12d | 1120 | 10.0 | 0.19 | 2.64 | 112 | A |
| 1 | 12e | 1530 | 10.0 | 0.18 | 2.57 | 116 | A |
| 1 | 12f | 2450 | 10.0 | 0.16 | 2.38 | 106 | A |
| 1 | 12g | 8900 | 10.0 | 0.15 | 2.31 | 98 | B |
| 1 | 12h | 16800 | 10.0 | 0.12 | 2.02 | 84 | C |

Thermal development was carried out similarly to processing A of Examples 1, except that processing was made at 70° C. for 90 sec. using aqueous medium No. 1 and 11a through 11h. The thus processed samples were evaluated similarly to Example 1 and results thereof are shown in Table 3a. Similarly, thermal development was carried out, provided that processing was made at 55° C. for 105 sec. using aqueous medium No. 2h and 12a through 12h. Results thereof are shown in Table 3b.

From the results, it was shown that there was a tendency that excessively low viscosity resulted in unevenness in processing and excessively high viscosity leading to a decrease in color density. It is supposed that excessively high viscosity retards diffusion of material needed for development and extending the thermal development time can recover to some extents.

Furthermore, when using aqueous mediums No. 2h and 12a through 12h, except that 0.5 g of adenine was replaced by 2.5 g of potassium bromide, results similar to the foregoing were achieved by optimally adjusting developing temperature and time in the foregoing process A.

Example 4

Aqueous mediums No. 13a through 13d, used for image formation were prepared similarly to aqueous medium No. 11e, except that the amount of disulfoethylhydroxylamine (also denoted simply as DSEHA) was varied as shown in Table 4. Aqueous mediums No. 14a through 14d, used for image formation were prepared similarly to aqueous medium No. 12e, except that the amount of disulfoethylhydroxylamine (also denoted as DSE-HA) was varied as shown in Table 4.

Aqueous mediums No. 11e, 12e, 13a through 13d and 14a through 14d were each sealed in an aluminum package for the shielding of air. After allowed to stand at 50° C. for 3 weeks, the remaining amount of CD-1 for each was measured using a high-performance liquid chromatography. Results thereof are shown in Table 4.

Processing A was carried similarly to example 1, using fresh aqueous mediums which were within 1 hr. after being prepared and aqueous mediums which were aged for 3 weeks under the foregoing condition, provided that processing element No. 1 was used and the developing temperature and time were each adjusted as shown in Table 4. Results are shown in Table 4.

Even when hydroxylamines represented by formula (A) described earlier, other than disulfoethylhydroxylamine (DSE-HA) were incorporated instead of DSE-HA, similar results were obtained. It is contemplated that an increase in Dmin, observed when using the aged aqueous medium is partially due to staining caused by decomposition of a color developing agent.

Furthermore, when using aqueous mediums similar to the foregoing aqueous mediums, except that 0.5 g of adenine was replaced by 2.5 g of potassium bromide, results similar to the foregoing were achieved by optimally adjusting developing temperature and time in the foregoing process A.

Example 5

Preparation of Aqueous Medium No. 19 through 22

Aqueous mediums No. 19 through 22, used for image formation were prepared similarly to aqueous medium No 1, except that the amount of sodium picolate was varied. The amount of sodium picolate was adjusted so as to have coverage as shown in Table 5.

Using the thus prepared aqueous mediums No. 19 to 22, processing was carried out similarly to processing a of example 1, except that thermal development was done at 70° C. for 90 sec. In this case, the amount of gelatin (a) contained in photographic material No. 1 and that of gelatin (b) contained in processing element No. 1 were 14 and 12 g/m$^2$, respectively. When aqueous medium No. 1 was coated on processing element No. 1, the amount of sodium picolate supplied as a complexing agent (c) was 96 mmol/m$^2$. In this Example, changing an aqueous medium varied the amount of sodium picolate, as shown in Table 5. Evaluation was made similarly to Example 1 and the results thereof are shown in Table 5.

TABLE 4

| Aqueous Medium | | | | Development | | Fresh Sample | | | | Aged Sample | | | |
|---|---|---|---|---|---|---|---|---|---|---|---|---|---|
| No. | pH | DSEHA*1 | CD-1*2 | Temp (° C.) | Time (sec) | Dmin | Dmax | S | Uniformity | Dmin | Dmax | S | Uniformity |
| 11e | 6.0 | 1.00 | 98 | 70 | 90 | 0.16 | 1.57 | 84 | A | 0.18 | 1.54 | 84 | A |
| 13a | 6.0 | 0.00 | 74 | 70 | 90 | 0.22 | 1.89 | 92 | B | 0.56 | 1.62 | 63 | C |
| 13b | 6.0 | 0.50 | 96 | 70 | 90 | 0.19 | 1.61 | 84 | A | 0.20 | 1.53 | 79 | A |
| 13c | 6.0 | 2.00 | 98 | 70 | 90 | 0.14 | 1.52 | 80 | A | 0.14 | 1.49 | 78 | A |
| 13d | 6.0 | 4.00 | 98 | 70 | 90 | 0.12 | 1.46 | 75 | A | 0.12 | 1.41 | 75 | A |
| 12e | 10.0 | 1.00 | 97 | 55 | 105 | 0.18 | 2.57 | 116 | A | 0.20 | 2.46 | 112 | A |
| 14a | 10.0 | 0.00 | 62 | 55 | 105 | 0.27 | 2.72 | 110 | B | 0.65 | 1.84 | 85 | C |
| 14b | 10.0 | 0.50 | 94 | 55 | 105 | 0.21 | 2.63 | 113 | A | 0.24 | 2.51 | 110 | A |
| 14c | 10.0 | 2.00 | 99 | 55 | 105 | 0.15 | 2.45 | 114 | A | 0.15 | 2.43 | 113 | A |
| 14d | 10.0 | 4.00 | 100 | 55 | 105 | 0.13 | 2.23 | 109 | A | 0.12 | 2.25 | 111 | A |

*1: Disulfoethylhydroxylamine (expressed in g)
*2: Remaining amount of CD-1 after storage (%)

As can be seen from Table 4, incorporation of disulfoethylhydroxylamine effectively enhanced storage stability of the aqueous mediums relating to the invention. It was also effective to increase disulfoethylhydroxylamine when the pH of the aqueous medium was relatively high.

TABLE 5

| Processing Element | Aqueous | Sodium Picolate | | Processing of 90 sec. | | | |
|---|---|---|---|---|---|---|---|
| No. | Medium No. | (mmol/m$^2$) | c/(a + b) | Dmin | Dmax | S | Uniformity |
| 1 | 1 | 96 | 3.7 | 0.18 | 1.79 | 87 | A |
| 1 | 19 | 16 | 0.6 | 0.10 | 0.78 | 45 | B |
| 1 | 20 | 32 | 1.2 | 0.15 | 1.45 | 76 | A |
| 1 | 21 | 250 | 9.6 | 0.22 | 1.41 | 79 | B |
| 1 | 22 | 360 | 13.8 | 0.13 | 0.98 | 54 | C |

Example 6

Preparation of Processing Element No. 3 through 6

Processing elements No. 3 to 6 were prepared similarly to processing element No. 1, except that the amount of zinc oxide was varied, as shown in Table 6. Processing was carried out at 70° C. for 90 sec. similarly to processing A of Example 1, provided that processing elements No. 3 to 6 were used in place of processing element No. 1, and aqueous mediums No. 1 and aqueous mediums No. 20 and 21 prepared in Example 5 were used. Subsequently, evaluation was made similarly to Example 1 and results thereof are shown in Table 6.

TABLE 6

| Processing Element | Aqueous Medium | Zinc Oxide | Sodium Picolate | | Processing of 90 sec. | | | |
|---|---|---|---|---|---|---|---|---|
| No. | No. | (mmol/m$^2$) | (mmol/m$^2$) | d/c | Dmin | Dmax | S | Uniformity |
| 1 | 1 | 55 | 96 | 0.6 | 0.18 | 1.79 | 87 | A |
| 1 | 20 | 55 | 32 | 1.7 | 0.15 | 1.45 | 76 | A |
| 1 | 21 | 55 | 250 | 0.2 | 0.22 | 1.41 | 79 | B |
| 3 | 1 | 110 | 96 | 1.1 | 0.18 | 1.96 | 92 | A |
| 3 | 20 | 110 | 32 | 3.4 | 0.16 | 1.61 | 84 | A |
| 4 | 20 | 180 | 32 | 5.6 | 0.18 | 1.72 | 89 | B |
| 5 | 20 | 250 | 32 | 7.8 | 0.17 | 1.69 | 90 | C |
| 6 | 21 | 28 | 250 | 0.1 | 0.12 | 1.24 | 64 | B |

Example 7

Preparation of Aqueous Medium No. 23 through 26

Aqueous mediums No. 23 to 26 were prepared similarly to aqueous medium No. 1, except that the amount of water added at the final stage (i.e., finishing water) was varied. The amount of finishing water was so adjusted that the amount of water coated on the processing element in the processing stage was that shown in Table 7.

Processing was carried out at 70° C. for 120 sec. similarly to process A of Example 1, provided that aqueous mediums No. 23 to 26 were used. In this case, the amount of gelatin (a) contained in photographic material No. 1 and that of gelatin (b) contained in processing element No. 1 were 14 and 12 g/m$^2{}_1$, respectively. When aqueous medium No. 1 was coated on processing element No. 1, the amount of water contained therein (e) was 95 g/m$^2$. In this Example, changing an aqueous medium and variation of coating layer thickness by a blade coater varied the amount of water, substantially without varying contents of ingredients of the aqueous medium, other than water. Evaluation was made similarly to Example 1 and the results thereof are shown in Table 7.

TABLE 7

| Processing | Aqueous | Content of Water | | Processing of 120 sec. | | | |
|---|---|---|---|---|---|---|---|
| Element No. | Medium No. | (g/m$^2$) | e/(a + b) | Dmin | Dmax | S | Uniformity |
| 1 | 1 | 95 | 3.6 | 0.25 | 2.16 | 98 | A |
| 1 | 23 | 24 | 0.9 | 0.23 | 1.58 | 91 | B |
| 1 | 24 | 48 | 1.8 | 0.28 | 2.36 | 108 | A |
| 1 | 25 | 142 | 5.4 | 0.22 | 2.07 | 85 | A |
| 1 | 26 | 190 | 7.3 | 0.17 | 1.76 | 78 | B |

Example 8

Process C

On the emulsion layer side of photographic material No. 1, aqueous mediums was coated by a blade coater so as to have a thickness of 100 μm and further thereon, the gelatin layer side of processing element No. 1 was superposed and thermal development was carried out at 70° C. for 90 sec or 120 sec, using a heated drum. After completion of processing, the processing element was peeled off from the photographic material and the photographic material having black wedge-wise images were obtained. The thus processed photographic material samples were evaluated similarly to Example 1 and results thereof are shown in Table 8.

TABLE 8

| | Processing Element | Aqueous Medium | | Processing of 90 sec. | | | | Processing of 120 sec. | | | |
|---|---|---|---|---|---|---|---|---|---|---|---|
| Processing | No. | No. | pH | Dmin | Dmax | S | Uniformity | Dmin | Dmax | S | Uniformity |
| A | 1 | 1 | 6.0 | 0.18 | 1.79 | 87 | A | 0.25 | 2.16 | 98 | A |
| A | 1 | 2c | 5.0 | 0.16 | 1.62 | 78 | A | 0.19 | 1.97 | 94 | A |
| A | 1 | 2d | 7.0 | 0.24 | 1.98 | 93 | A | 0.36 | 2.36 | 102 | A |
| C | 1 | 1 | 6.0 | 0.16 | 1.60 | 73 | A | 0.24 | 2.07 | 91 | A |
| C | 1 | 2c | 5.0 | 0.15 | 1.47 | 65 | B | 0.17 | 1.83 | 90 | A |
| C | 1 | 2d | 7.0 | 0.21 | 1.82 | 74 | A | 0.34 | 2.20 | 99 | A |

Similarly to the foregoing process A, image formation relating to the invention is feasible also in process C. As can be seen from Table 8, it was proved that a progress of development is retarded in process C, compared to process A. Process A is more preferable in terms of rapid image formation being feasible.

Example 9

Preparation of Aqueous Medium No. 27 through 32

Aqueous mediums No. 27 and 28 were prepared similarly to aqueous medium No. 1, except that the amount of 2-methyl-4-{N-ethyl-N-(β-hydroxyethyl)-amino}aniline (CD-1) was varied. Aqueous mediums No. 29 and 30 were prepared similarly to aqueous medium No. 1, except that CD-1 was replaced by a color developing agent precursor (CDP-1), represented by the following formula. Similarly, aqueous medium No. 31 and 32 were prepared, provided that CD-1 and CDP-1 were used in combination.

CDP-1

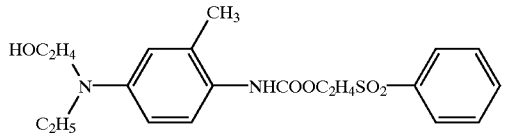

TABLE 9

| Aqueous Medium No. | CD-1 (g/mmol) | CDP-1 (g/mmol) | Sum of CD-1 and CDP-1 (mmol) |
|---|---|---|---|
| 1 | 2.63/9.0 | 0.00/0.0 | 9.0 |
| 27 | 1.32/4.5 | 0.00/0.0 | 4.5 |
| 28 | 5.26/18.0 | 0.00/0.0 | 18.0 |

TABLE 9-continued

| Aqueous Medium No. | CD-1 (g/mmol) | CDP-1 (g/mmol) | Sum of CD-1 and CDP-1 (mmol) |
|---|---|---|---|
| 29 | 0.00/0.0 | 3.66/9.0 | 9.0 |
| 30 | 0.00/0.0 | 5.50/13.5 | 13.5 |
| 31 | 1.32/4.5 | 3.66/9.0 | 13.5 |
| 32 | 1.32/4.5 | 5.50/13.5 | 18.0 |

Processing was carried out similarly to the foregoing process A of Example 1, provided that aqueous mediums No. 27 to 32 were used in place of aqueous medium No. 1. In this Example, the coating layer thickness was varied using a blade coater to vary the amount of color developing agent (CD-1) or developing agent precursor (CDP-1), as shown in Table 10. Evaluation was made similarly to Example 1 and the results thereof are shown in Table 10.

TABLE 10

| Processing Element | Aqueous Medium | Developer | Content of CD-1 and | Coating Thickness | Coverage of CD-1 and CDP- | Processing of 90 sec. | | | | Processing of 120 sec. | | | |
|---|---|---|---|---|---|---|---|---|---|---|---|---|---|
| No. | No. | | CDP-1*1 | (μm) | 1*2 | Dmin | Dmax | S | Uniformity | Dmin | Dmax | S | Uniformity |
| 1 | 1 | CD-1 | 9.0 | 100 | 9.0 | 0.18 | 1.79 | 87 | A | 0.25 | 2.16 | 98 | A |
| 1 | 27 | CD-1 | 4.5 | 100 | 4.5 | 0.14 | 1.25 | 67 | A | 0.23 | 1.89 | 81 | A |

TABLE 10-continued

| Processing Element No. | Aqueous Medium No. | Developer | Content of CD-1 and CDP-1*1 | Coating Thickness (μm) | Coverage of CD-1 and CDP-1*2 | Processing of 90 sec. Dmin | Dmax | S | Uniformity | Processing of 120 sec. Dmin | Dmax | S | Uniformity |
|---|---|---|---|---|---|---|---|---|---|---|---|---|---|
| 1 | 27 | CD-1 | 4.5 | 75 | 3.4 | 0.1 | 1.02 | 50 | A | 0.19 | 1.38 | 67 | A |
| 1 | 27 | CD-1 | 4.5 | 50 | 2.3 | 0.06 | 0.89 | 34 | C | 0.15 | 0.97 | 54 | B |
| 1 | 28 | CD-1 | 18.0 | 100 | 18.0 | 0.24 | 2.01 | 99 | B | 0.35 | 2.45 | 110 | B |
| 1 | 28 | CD-1 | 18.0 | 200 | 36.0 | 0.3 | 2.26 | 97 | B | 0.45 | 2.56 | 101 | B |
| 1 | 29 | CDP-1 | 9.0 | 100 | 9.0 | 0.13 | 1.18 | 59 | A | 0.22 | 1.86 | 85 | A |
| 1 | 30 | CDP-1 | 13.5 | 100 | 13.5 | 0.17 | 1.71 | 90 | A | 0.25 | 2.09 | 96 | A |
| 1 | 31 | CD-1, CDP-1 | 13.5 | 100 | 13.5 | 0.19 | 1.78 | 92 | A | 0.27 | 2.11 | 103 | A |
| 1 | 32 | CD-1, CDP-1 | 18.5 | 100 | 18.5 | 0.22 | 1.89 | 93 | A | 0.31 | 2.35 | 109 | A |
| 1 | 32 | CD-1, CDP-1 | 18.5 | 150 | 27.8 | 0.27 | 2.03 | 92 | B | 0.35 | 2.45 | 105 | B |
| 1 | 32 | CD-1, CDP-1 | 18.5 | 250 | 46.3 | 0.33 | 2.24 | 88 | C | 0.42 | 2.59 | 96 | B |

*1: Amount of CD-1 and CDP-1 contained in aqueous medium (mmol/100 ml)
*2: Coating amount of CD-1 and CDP-1 (mmol/m$^2$)

Example 10

Processing was conducted similarly to the foregoing process A, except that the developing temperature and time were varied, as shown in Tables 11a and 11b. The thus processed samples were evaluated with respect to time necessary to obtain the maximum density (Dmax) of 1.5 or more and uniformity in processing, and results thereof are shown in Tables 11a and 11b. In this Example, the developing time was 30, 60, 90, 120, 240, and 360 sec. and the time shown in the Tables is a necessary to reach Dmax of 1.5.

As can be seen from the results shown in Tables 11a and 11b, the image forming process relating to the invention is applicable to a broad temperature range of 43 to 95° C. To perform rapid processing with minimizing unevenness in processing, it is appropriate to set a pH, viscosity and developing temperature within the preferable region of the invention.

Example 11

Preparation of Processing Element No. 7

An aqueous 20% gelatin solution was adjusted to a pH of 6.5 and aqueous sodium picolinate solution was added TABLE 11a

| Processing | Processing Element No. | Aqueous Medium No. | pH | 43° C. Time (sec) | Uniformity | 55° C. Time (sec) | Uniformity | 70° C. Time (sec) | Uniformity | 80° C. Time (sec) | Uniformity | 95° C. Time (sec) | Uniformity |
|---|---|---|---|---|---|---|---|---|---|---|---|---|---|
| A | 1 | 1 | 6.0 | 360 | A | 240 | A | 90 | A | 60 | A | 30 | A |
| A | 1 | 2a | 3.5 | — | C | — | C | — | C | — | C | — | C |
| A | 1 | 2b | 4.0 | — | C | 360 | B | 180 | B | 120 | B | 60 | B |
| A | 1 | 2c | 5.0 | 360 | B | 240 | A | 90 | A | 90 | A | 30 | A |
| A | 1 | 2d | 7.0 | 360 | A | 180 | A | 90 | A | 60 | A | 30 | A |
| A | 1 | 2e | 8.0 | 240 | B | 90 | A | 60 | A | 60 | B | 30 | B |
| A | 1 | 2f | 9.0 | 180 | B | 120 | B | 60 | A | 30 | B | 30 | C |
| A | 1 | 2g | 9.5 | 180 | C | 120 | B | 60 | B | 30 | B | 30 | C |

TABLE 11b

| Processing | Processing Element No. | Aqueous Medium No. | pH | Viscosity (cp) | 45° C. Time (sec) | Uniformity | 50° C. Time (sec) | Uniformity | 55° C. Time (sec) | Uniformity | 60° C. Time (sec) | Uniformity | 70° C. Time (sec) | Uniformity |
|---|---|---|---|---|---|---|---|---|---|---|---|---|---|---|
| A | 1 | 2h | 10.0 | 30 | 90 | B | 60 | B | 60 | B | 60 | B | 30 | B |
| A | 1 | 12c | 10.0 | 540 | 120 | B | 90 | A | 90 | A | 60 | A | 60 | A |
| A | 1 | 12d | 10.0 | 1120 | 120 | B | 90 | A | 90 | A | 60 | A | 60 | A |
| A | 1 | 12e | 10.0 | 1530 | 120 | A | 90 | A | 90 | A | 60 | A | 60 | B |
| A | 1 | 12f | 10.0 | 2450 | 180 | B | 120 | A | 90 | A | 90 | A | 60 | B |

thereto with stirring. The thus prepared solution was coated by casting on a transparent subbed PEN support of 85 μm thick so as to have a coverage of 96 mmol/m$^2$, then was allowed to stand under conditions of 23° C. and 50% RH for 10 hrs and further aged at 40° C. and 80% RH for 14 hrs. A 10 μm thick gelatin layer containing sodium picolinate was formed on the transparent PEN support. The gelatin coating amount was 12 g/m$^2$.

| Preparation of Aqueous Medium No. 33 | |
|---|---|
| Carboxymethyl cellulose | 3.0 g |
| Adenine | 0.5 g |
| Sodium sulfite | 0.33 g |
| Disulfoethylhydroxylamine | 1.00 g |
| 2-Methyl-4-{N-ethyl-N-(-hydroxyethyl-amino} aniline sulfate (hereinafter, denoted as CD-1) | 2.63 g |
| Zinc oxide (av. particle size 200 nm) | 31.3 g |
| TORITON X-200 (available from UNION CARBIDE Co.) | 0.55 g |
| Water | 60 g |

The foregoing mixture was dissolved, then, adjusted to a pH of 7.0 at 25° C. using aqueous 30% sodium hydroxide and aqueous 10% sulfuric acid and water was added thereto to make 100 ml.

Using the thus prepared processing element No. 7 and aqueous medium No. 33, processing was carried out similarly to processing A of Example 1 and evaluated. As a result, it was proved that image formation was also feasible in the embodiment of this example.

Example 12

Photographic material No. 1 prepared in Example 1 was cut to a format of 135-size for use of 24 shots and put into a film patrone and loaded into a camera (Big Mini NEO, available from Konica Corp.). Using this, test patterns were photographed to obtain exposed negative film. The thus photographed negative film was processed in the foregoing process A of Example 1 at 70° C. for 120 sec., using processing element No. 1 and aqueous medium No. 1.

From the developed negative film which was peeled from the processing element, R, G and B separation negative images were obtained using a halogen light source, LA-150UX (180W, available from HAYASHI TOKEI-KOGYO Co., Ltd.) and a monochromatic CCD camera of 2048×2048 pixels (KX4, available from Eastman Kodak Co.), in which a red separation filter (gelatin filter No. W26, available from Eastman Kodak Co.), a green separation filter (No. W99) or a blue separation filter (No. W98) was arranged between the light source and film. The thus obtained RGB image data were outputted onto Konica color paper type QAA7 of L-size (89×127 mm) and 2L-size (127×178 mm) to obtain color prints, using digital minilab QD-21 (available from Konica Corp.). The obtained print samples were denoted as output samples A1 and A2

The negative film exposed as above was also processed in the foregoing process B of Example 1 to obtain the developed negative film. From the thus developed negative film, R, G and B separation negative images were also obtained in the same manner as described above and outputted as color prints of L-size and 2L-size, using digital minilab QD-21 (available from Konica Corp.). The obtained print samples were denoted as output samples B1 and B2. From comparison of samples A1 and B1, no significant difference in image quality between them was observed. From comparison of samples A2 and B2, sample A2 was slightly inferior in image quality to sample B2 but was an acceptable level.

Example 13

Similarly to Example 12, photographic material No. 1 was cut to a 135-size, 24-shootable format and put into a film patrone and loaded into a camera (Big Mini NEO, available from Konica Corp.). Using this, test patterns were photographed to obtain exposed negative film. The thus photographed negative film was processed in the foregoing process A of Example 1 at 70° C. for 120 sec., using processing element No. 1 and aqueous medium No. 1. Photographic material No. 1 was read out as such, without being peeled off from each other, similarly to example 12 and outputted as L-size and 2L-size color prints. These samples were denoted as output samples C1 and C2. From comparison of samples C1 and A1, significant difference in image quality was observed between them. From comparison of samples C2 and A2, no significant difference in image quality was also observed between them.

Example 14

Preparation of Processing Element Nos. 11 through 17

Processing elements No. 11 through 17 were prepared similarly to processing element No. 1 of Example 1, except that 0.5 g of a compound described in Table 12a was added to the aqueous 20% gelatin solution.

| Preparation of Aqueous Medium No. 41 | |
|---|---|
| Carboxymethyl cellulose | 3.0 g |
| Sodium sulfite | 0.33 g |
| Disulfoethylhydroxylamine (A-25) | 1.00 g |
| 2-Methyl-4-{N-ethyl-N-(-hydroxyethyl-amino} aniline sulfate (hereinafter, denoted as CD-1) | 2.63 g |
| Sodium picolinate | 14.0 g |
| TORITON X-200 (available from UNION CARBIDE Co.) | 0.55 g |
| Water | 60 g |

The foregoing mixture was dissolved, and then, adjusted to a pH of 6.0 at 25° C. using aqueous 30% sodium hydroxide and aqueous 10% sulfuric acid, after which water was added thereto to make 100 ml. The thus prepared aqueous medium 1 exhibited a viscosity of 30 cp.

Preparation of Aqueous Medium Nos. 42 through 47

Aqueous medium Nos. 42 through 47 were prepared similarly to aqueous medium No. 41, except that 0.5 g of a compound described in Table 12a was added. The thus prepared aqueous mediums all exhibited a viscosity of 30 cp.

Preparation of Aqueous Medium Nos. 48 through 57.

Aqueous mediums No. 48 through 57 were prepared similarly to aqueous mediums No. 41 through 47, except that the pH was varied as shown in Table 12b.

Using processing elements and aqueous mediums shown in Tables 12a and 12b, thermal development was carried out at 70° C. for 90 sec. or 120 sec. in process A of Example 1 and processed samples were evaluated similarly to Example 1. Results thereof are shown in Tables 12a and 12b. Sensitivity was represented by relative value, based on the sensitivity obtained in process B being 100. Processed samples were visually evaluated with respect to uniformity in processing, based on the following criteria:

A: no unevenness

B: slight unevenness

C: marked unevenness.

Results are shown in Tables 12a and 12b. The foregoing aqueous mediums No. 41 through 57 were allowed to stand in an atmosphere of 50° C. for one day and visually evaluated with respect to change in color, based on the following criteria:

A: no change

B: slightly coloring

C: markedly coloring.

Results are also shown in Table 12b.

TABLE 12a

| | Processing Element | | Aqueous Medium | | | | Processing of 90 sec. | | | | Processing of 120 sec. | | | |
|---|---|---|---|---|---|---|---|---|---|---|---|---|---|---|
| Processing | No. | Compound | No. | Compound | pH | Storage Stability | Dmin | Dmax | S | Uniformity | Dmin | Dmax | S | Uniformity |
| A | 1 | | 41 | — | 6.0 | B | 0.80 | 2.03 | 52 | B | 1.02 | 2.33 | 57 | C |
| A | 11 | 2-2 | 41 | — | 6.0 | B | 0.19 | 1.83 | 83 | A | 0.22 | 2.19 | 102 | A |
| A | 12 | 3-4 | 41 | — | 6.0 | B | 0.15 | 1.78 | 92 | A | 0.24 | 2.12 | 101 | A |
| A | 13 | 4-19 | 41 | — | 6.0 | B | 0.18 | 1.79 | 87 | A | 0.25 | 2.16 | 98 | A |
| A | 13 | 4-19 | 44 | 4-23 | 6.0 | B | 0.12 | 1.66 | 81 | A | 0.15 | 1.99 | 93 | A |
| A | 13 | 4-19 | 53 | 4-23 | 10.0 | A | 0.15 | 2.11 | 94 | A | 0.18 | 2.30 | 102 | A |
| A | 14 | 4-23 | 41 | — | 6.0 | B | 0.17 | 1.75 | 86 | A | 0.23 | 2.13 | 97 | A |
| A | 15 | 5-1 | 41 | — | 6.0 | B | 0.21 | 1.89 | 84 | A | 0.24 | 2.25 | 97 | A |
| A | 16 | 6-1 | 41 | — | 6.0 | B | 0.18 | 1.86 | 82 | A | 0.29 | 2.25 | 103 | A |
| A | 17 | 7-1 | 41 | — | 6.0 | B | 0.19 | 1.73 | 88 | A | 0.23 | 2.16 | 99 | A |
| A | 1 | | 42 | 2-2 | 6.0 | B | 0.17 | 1.89 | 81 | A | 0.19 | 2.28 | 100 | A |
| A | 1 | | 43 | 3-4 | 6.0 | B | 0.12 | 1.68 | 88 | A | 0.25 | 2.19 | 97 | A |
| A | 1 | | 44 | 4-23 | 6.0 | B | 0.13 | 1.80 | 85 | A | 0.20 | 2.20 | 94 | A |
| A | 1 | | 45 | 5-1 | 6.0 | B | 0.23 | 1.88 | 83 | A | 0.22 | 2.34 | 97 | A |
| A | 1 | | 46 | 6-1 | 6.0 | B | 0.14 | 1.96 | 85 | A | 0.28 | 2.22 | 98 | A |
| A | 1 | | 47 | 7-1 | 6.0 | B | 0.16 | 1.65 | 87 | A | 0.25 | 2.14 | 96 | A |

TABLE 12b

| | Processing Element | | Aqueous Medium | | | | Processing of 90 sec. | | | |
|---|---|---|---|---|---|---|---|---|---|---|
| Processing | No. | Compound | No. | Compound | pH | Storage Stability | Dmin | Dmax | S | Uniformity |
| A | 13 | 4-19 | 48 | — | 8.0 | A | 0.20 | 1.94 | 91 | A |
| A | 13 | 4-19 | 49 | — | 10.0 | A | 0.22 | 2.05 | 94 | A |
| A | 1 | — | 50 | 2-2 | 10.0 | B | 0.19 | 2.25 | 97 | A |
| A | 1 | — | 51 | 3-4 | 10.0 | A | 0.21 | 2.01 | 95 | A |
| A | 1 | — | 52 | 4-23 | 8.0 | A | 0.15 | 2.05 | 96 | A |
| A | 1 | — | 53 | 4-23 | 10.0 | A | 0.18 | 2.25 | 101 | A |
| A | 1 | — | 54 | 4-23 | 12.0 | C | 0.64 | 2.98 | 73 | B |
| A | 1 | — | 55 | 5-1 | 10.0 | B | 0.24 | 2.38 | 95 | A |
| A | 1 | — | 56 | 6-1 | 10.0 | A | 0.22 | 2.11 | 93 | A |
| A | 1 | — | 57 | 7-1 | 10.0 | B | 0.23 | 2.03 | 90 | A |

As can be seen from Tables 12a and 12b, the use of compounds represented by formulas (2) through (8) led to images of relatively high Dmax and relatively low fogging at enhanced sensitivity, even when subjected to rapid processing of 90 to 120 sec. It was also proved that the aqueous mediums could be safely used at a pH equal to or lower than that of conventional developer solution (such as process B).

Example 15

Aqueous mediums were prepared similarly to aqueous medium No. 42, except that the amount of carboxymethyl cellulose was varied to vary the viscosity within the range of 5 cp to 20,000 cp. Using these aqueous mediums, thermal development was carried out in the foregoing process A and evaluated similarly to Example 14. From the results, it was shown that there was a tendency that excessively low viscosity resulted in unevenness in processing and excessively high viscosity leading to a decrease in color density. It is contemplated that excessively high viscosity retards diffusion of material needed for development and extending the thermal development time can recover to some extents.

Example 16

Preparation of Aqueous Medium No. 58

Aqueous medium No. 58 was prepared similarly to aqueous medium No. 41, except that 2-methyl-4-{N-ethyl-N-(-hydroxyethyl)-amino}aniline sulfate (CD-1) was replaced by an equimolar amount of color developing agent precursor described earlier (CDP-1).

Preparation of Aqueous Medium Nos. 59 through 64

Aqueous medium Nos. 59 through 64 were prepared similarly to aqueous medium No. 58, except that 0.5 g of a compound described in Table 13 was further incorporated.

Using aqueous medium Nos. 9 to 64, thermal development was carried out a process A of Example 1 and evaluated similarly to Example 1. Results thereof are shown in Table 13.

TABLE 13

| | Processing Element | | Aqueous Medium | | | | Processing of 90 sec. | | | | Processing of 120 sec. | | | |
|---|---|---|---|---|---|---|---|---|---|---|---|---|---|---|
| Processing | No. | Compound | No. | Compound | pH | Storage Stability | Dmin | Dmax | S | Uniformity | Dmin | Dmax | S | Uniformity |
| A | 1 | | 58 | | 6.0 | A | 0.78 | 1.99 | 51 | B | 0.99 | 2.32 | 55 | C |
| A | 1 | | 59 | 2-2 | 6.0 | A | 0.17 | 1.86 | 83 | A | 0.17 | 2.22 | 99 | A |
| A | 1 | | 60 | 3-4 | 6.0 | A | 0.08 | 1.65 | 90 | A | 0.23 | 2.15 | 98 | A |
| A | 1 | | 61 | 4-23 | 6.0 | A | 0.10 | 1.75 | 84 | A | 0.20 | 2.11 | 90 | A |
| A | 1 | | 62 | 5-1 | 6.0 | A | 0.19 | 1.87 | 85 | A | 0.21 | 2.33 | 97 | A |
| A | 1 | | 63 | 6-1 | 6.0 | A | 0.09 | 1.93 | 85 | A | 0.25 | 2.22 | 98 | A |
| A | 1 | | 64 | 7-1 | 6.0 | A | 0.13 | 1.60 | 87 | A | 0.25 | 2.13 | 93 | A |

As can be seen from Table 13, images of relatively high Dmax were obtained at a relatively high sensitivity and low fogging by the image forming process relating to the invention, even when subjected to rapid processing of 90 to 120 sec. It was further proved that the use of a color developing agent precursor suitably enhanced storage stability of the aqueous medium.

Example 17

Photographic material No. 1 prepared in Example 1 was cut to a format of 135-size for use of 24 shots and put into a film patrone and loaded into a camera (Big Mini NEO, available from Konica Corp.). Using this, test patterns were photographed to obtain exposed negative film. The thus photographed negative film was processed in process A of Example 1 at 70° C. for 120 sec., using processing element No. 11 and aqueous medium No. 53.

From the developed negative film which was peeled from the processing element, R, G and B separation negative images were obtained using a halogen light source, LA-150UX (180W, available from HAYASHI TOKEI-KOGYO Co., Ltd.) and a monochromatic CCD camera of 2048×2048 pixels (KX4, available from Eastman Kodak Co.), in which a red separation filter (gelatin filter No. W26, available from Eastman Kodak Co.), a green separation filter (No. W99) or a blue separation filter (No. W98) was arranged between the light source and film. The thus obtained RGB image data were outputted onto Konica color paper type QAA7 of L-size (89×127 mm) and 2L-size (127×178 mm) to obtain color prints, using digital minilab QD-21 (available from Konica Corp.). The obtained print samples were denoted as output samples A11 and A12.

Output samples A11 and A12 were compared with output samples B1 and B2. Thus, from comparison of samples A11 and B1, no significant difference in image quality was observed between them. From comparison A12 and B2, slight difference in image quality was observed between them, but falling within the acceptable range.

Example 18

Similarly to Example 17, photographic material No. 1 was cut to a 135-size, 24-shootable format and put into a film patrone and loaded into a camera (Big Mini NEO, available from Konica Corp.). Using this, test patterns were photographed to obtain exposed negative film. The thus photographed negative film was processed in process A of Example 1 at 70° C. for 120 sec., using processing element No. 11 and aqueous medium No. 53. The photographic material No. 1 were read out as much, without being peeled off from each other, similarly to Example 17 and outputted as L-size and 2L-size color prints. These samples were denoted as output samples C11 and C12. From comparison of samples C11 and A11, significant difference in image quality was observed between them. From comparison of samples C12 and A12, no significant difference was also observed between them.

What is claimed is:

1. An image formation process comprising:

(a) imagewise exposing a silver halide photographic material comprising at least a silver halide emulsion layer to light, and (b) placing the exposed photographic material onto a processing element with an aqueous medium being present between the photographic material and the processing element to perform development to form an image in the photographic material, wherein the aqueous medium contains at least a color developing agent or a precursor thereof, and the aqueous medium having a viscosity of 10.1 and 15000 cp at 25° C., and in step (b), the aqueous medium is provided onto the processing element and further thereon, the photographic material is placed.

2. The image formation process of claim 1, wherein the aqueous medium has a pH of 4.0 to 11.0 at 25° C.

3. The image formation process of claim 2, wherein the aqueous medium has a pH of 4.0 to 9.0 at 25° C.

4. The image formation process of claim 1, wherein aqueous medium contains a base precursor.

5. The image formation process of claim 1, wherein the color developing agent and the precursor thereof are respectively a compound represented by the following formula (1) and a compound capable of releasing or forming the compound represented by the formula (1) in the presence of alkali:

formula (1)

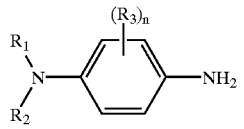

wherein $R_1$ and $R_2$ are each an alkyl group, an aryl group or a heterocyclic group, provided that $R_1$ and $R_2$ may combine with each other to form a ring;

$R_3$ is an alkyl group, an aryl group or a heterocyclic group, provided that plural $R_3$s may combine with each other to form a ring; and n is an integer of 0 to 4.

6. The image formation process of claim 1, wherein the aqueous medium contains at least one selected from the group consisting of compounds represented by the following formulas (2) through (7):

formula (2)

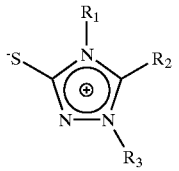

wherein $R_1$, $R_2$ and $R_3$ are each a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsufamoyl group, a sulfamoyl group, cyano group, an alkylsulfonyl group, an arylsulfonyl group, an alkoxycarbonyl group, an aryloxycarbonyl group, an alkylcarbonyl group, an arylcarbonyl group, an acyloxy group, a carboxyl group, a carbonyl group, a sulfonyl group, an amino group, a hydroxy group or a heterocyclic group;

formula (3)

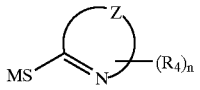

wherein M is a hydrogen atom, metal atom or quaternary ammonium;

Z represents an atomic group necessary to form a N-containing heterocycric ring;

n is an integer of 0 to 5;

$R_4$ is a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsufamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, an acyloxy group, carboxyl group, a carbonyl group, a sulfonyl group, an amino group, a hydroxy group or a heterocyclic group, provided that when n is 2 or more, plural $R_4$s may be the same or different and may combine with each other to form a ring;

formula (4)

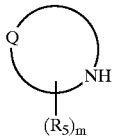

wherein Q represents an atomic group necessary to form a 5- or 6-membered N-containing heterocycric ring;

m is an integer of 0 to 5;

$R_5$ is a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsufamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, an acyloxy group, a carboxyl group, a carbonyl group, a sulfonyl group, an amino group, a hydroxy group or a heterocyclic group, provided that when m is 2 or more, plural $R_5$s may be the same or different and may combine with each other to form a ring;

$H_2N—R_6$ formula (5)

wherein $R_6$ is an alkyl group, an aryl group or a heterocyclic group;

formula (6)

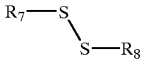

wherein $R_7$ and $R_8$ are each an alkyl group, aryl group or a heterocyclic group, provided that $R_7$ and $R_8$ may combine with each other to form a ring;

formula (7)

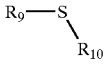

wherein $R_9$ and $R_{10}$ are each an alkyl group, aryl group or a heterocyclic group, provided that $R_9$ and $R_{10}$ may combine with each other to form a ring.

7. The image formation process of claim 1, wherein the processing element contains at least one compound selected from the group consisting of compounds represented by formulas (2) through (7)

formula (2)

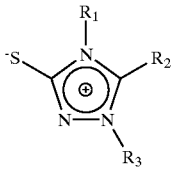

wherein $R_1$, $R_2$ and $R_3$ are each a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsufamoyl group, a sulfamoyl group, cyano group, an alkylsulfonyl group, an arylsulfonyl group, an alkoxycarbonyl group, an aryloxycarbonyl group, an alkylcarbonyl group, an arylcarbonyl group, an acyloxy group, a carboxyl group, a carbonyl group, a sulfonyl group, an amino group, a hydroxy group or a heterocyclic group;

formula (3)

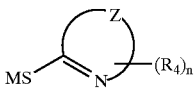

wherein M is a hydrogen atom, metal atom or quaternary ammonium;

Z represents an atomic group necessary to form a N-containing heterocyclic ring;

n is an integer of 0 to 5;

$R_4$ is a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsufamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, an acyloxy group, carboxyl group, a carbonyl group, a sulfonyl group, an amino group, a hydroxy group or a heterocyclic group, provided that when n is 2 or more, plural $R_4$s may be the same or different and may combine with each other to form a ring; formula (4)

formula (4)

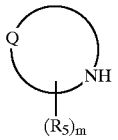

wherein Q represents an atomic group necessary to form a 5- or 6-membered N-containing heterocyclic ring;

m is an integer of 0 to 5;

$R_5$ is a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsufamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, an acyloxy group, a carboxyl group, a carbonyl group, a sulfonyl group, an amino group, a hydroxy group or a heterocyclic group, provided that when m is 2 or more, plural $R_3$s may be the same or different and may combine with each other to form a ring;

$H_2N—R_6$ formula (5)

wherein $R_6$ is an alkyl group, an aryl group or a heterocyclic group;

formula (6)

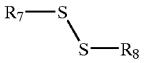

wherein $R_7$ and $R_8$ are each an alkyl group, aryl group or a heterocyclic group, provided that $R_7$ and $R_8$ may combine with each other to form a ring;

formula (7)

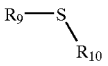

wherein $R_9$ and $R_{10}$ are each an alkyl group, aryl group or a heterocyclic group, provided that $R_9$ and $R_{10}$ may combine with each other to form a ring.

8. The image formation process of claim 6, wherein the color developing agent and the precursor thereof are a compound represented by formula (1) and a compound capable of releasing or forming the compound represented by the formula (1) in the presence of alkali, respectively, formula (1)

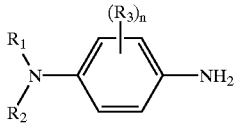

wherein $R_1$ and $R_2$ are each an alkyl group, an aryl group or a heterocyclic group, provided that $R_1$ and $R_2$ may combine with each other to form a ring;

$R_3$ is an alkyl group, an aryl group or a heterocyclic group, provided that plural $R_3$s may combine with each other to form a ring; and n is an integer of 0 to 4.

9. The image formation process of claim 7, wherein the color developing agent and the precursor of the color developing agent are a compound represented by formula (1) and a compound capable of releasing or forming the compound represented by the formula (1) in the presence of alkali, respectively, formula (1)

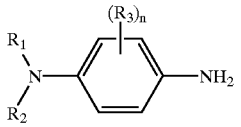

wherein $R_1$ and $R_2$ are each an alkyl group, an aryl group or a heterocyclic group, provided that $R_1$ and $R_2$ may combine with each other to form a ring;

$R_3$ is an alkyl group, an aryl group or a heterocyclic group, provided that plural $R_3$s may combine with each other to form a ring; and n is an integer of 0 to 4.

10. The image formation process of claim 1, wherein the aqueous medium contains a compound represented by the following formula (A):

formula (A)

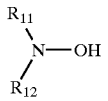

wherein $R_{11}$, and $R_{12}$ are each a hydrogen atom or an alkyl group, provided that $R_{11}$ and $R_{12}$ are not hydrogen atoms at the same time and $R_{11}$ and $R_{12}$ may combine with each other to form a ring.

11. The image formation process of claim 1, wherein the photographic material is substantially free of a color developing agent and a precursor thereof.

12. The image formation process of claim 1, wherein the processing element is substantially free of a color developing agent and a precursor thereof.

13. The image formation process of claim 1, wherein the processing element contains a sparingly water-soluble basic metal compound, and the aqueous medium containing a complex compound.

14. The image formation process of claim 1, where the processing element contains a complex forming compound, and the aqueous medium containing a sparingly water-soluble basic metal compound.

15. The image formation process of claim 13, wherein the following requirement is met:

$$1 \leqq c/(a+b) \leqq 10$$

wherein a is an amount of gelatin contained in the photographic material (expressed in $g/m^2$), b is an amount of gelatin contained in the processing element (expressed in $g/m^2$) and c is an amount of the complex forming compound contained in the aqueous medium (expressed in $mmol/m^2$).

16. The image formation process of claim 14, wherein the following requirement is met:

$$1 \leqq c/(a+b) \leqq 10$$

wherein a is an amount of gelatin contained in the photographic material (expressed in $g/m^2$), b is an amount of gelatin contained in the processing element (expressed in $g/m^2$) and c is an amount of the complex forming compound contained in the processing element (expressed in $mmol/m^2$).

17. The image formation process of claim 13, wherein the following requirement is met:

$$0.2 \leqq d/c \leqq 6$$

wherein c is an amount of the complex forming compound contained in the aqueous medium (expressed in $mmol/m^2$) and d is an amount of the sparingly water-soluble basic metal compound contained in the processing element (expressed in $mmol/m^2$).

18. The image formation process of claim 14, wherein the following requirement is met:

$$0.2 \leqq d/c \leqq 6$$

wherein c is an amount of the complex forming compound contained in the processing element (expressed in $mmol/m^2$) and d is an amount of the sparingly water-soluble basic metal compound contained in the aqueous medium (expressed in $mmol/m^2$).

19. The image formation process of claim 1, wherein the following requirement is met:

$$1 \leqq e/(a+b) \leqq 6$$

wherein a is an amount of gelatin contained in the photographic material (expressed in $g/m^2$), b is an amount of gelatin contained in the processing element (expressed in $g/m^2$) and e is an amount of water contained in the aqueous medium (expressed in $g/m^2$).

20. The image formation process of claim 1, wherein the following requirement is met:

$$3 \leqq f \leqq 40$$

wherein an amount of the color developing agent or the precursor thereof contained in the aqueous medium (expressed in $mmol/m^2$).

21. The image formation method of claim 1, wherein in step (b), the development is performed at a temperature of 43° C. to 95° C.

22. The image formation process of claim 21, wherein in step (b), the development is performed at a temperature of 50° C. to 95° C.

23. The image formation process of claim 1, wherein the photographic material comprises on a support a blue-sensitive silver halide emulsion layer containing a yellow dye forming coupler, a green-sensitive silver halide emulsion layer containing a magenta dye forming coupler and a red-sensitive silver halide emulsion layer containing a cyan dye forming coupler.

* * * * *